United States Patent [19]

Berkelmans et al.

[11] Patent Number: 4,804,279

[45] Date of Patent: Feb. 14, 1989

[54] REAL-TIME WORD TYPEWRITER

[75] Inventors: Nicolaas M. Berkelmans, Apeldoorn; Marius Den Outer, deceased, late of Hulshorst; by Annie Den Outer, legal representative, Dieren, all of Netherlands

[73] Assignee: Special Systems Industry B.V., Rijswijk, Netherlands

[21] Appl. No.: 811,656

[22] Filed: Dec. 19, 1985

Related U.S. Application Data

[63] Continuation-in-part of Ser. No. 657,775, Oct. 4, 1984, abandoned, which is a continuation-in-part of Ser. No. 348,008, filed as PCT NL81/00018 on Jun. 15, 1981, published as WO81/03641 on Dec. 24, 1981, abandoned.

[30] Foreign Application Priority Data

Jun. 13, 1980 [NL] Netherlands ..... 8003451
Jun. 15, 1981 [WO] PCT Int'l Appl. ... PCT/NL81/00018

[51] Int. Cl.[4] ..... B41J 3/26
[52] U.S. Cl. ..... 400/94; 400/482
[58] Field of Search ..... 400/91, 92, 93, 94, 400/95, 96, 97, 98, 99, 100, 101, 102, 110, 482, 484

[56] References Cited

U.S. PATENT DOCUMENTS

| | | | |
|---|---|---|---|
| 2,154,577 | 4/1939 | Outer | 400/482 |
| 2,318,519 | 5/1943 | Palarque | 400/482 |
| 2,449,126 | 9/1948 | Kirkpatrick | 400/93 |
| 3,557,927 | 1/1971 | Wright | 400/94 |
| 3,558,820 | 1/1971 | Baisch | 400/282 X |
| 3,945,482 | 3/1976 | Einbinder . | |
| 3,970,185 | 7/1976 | Shelton | 400/482 |
| 4,279,022 | 7/1981 | Abe | 364/705 X |

FOREIGN PATENT DOCUMENTS

| | | |
|---|---|---|
| 875817 | 10/1942 | France . |
| 2388678 | 11/1978 | France . |
| 7306584 | 11/1974 | Netherlands . |

*Primary Examiner*—Charles A. Pearson
*Attorney, Agent, or Firm*—Arnold, White & Durkee

[57] ABSTRACT

A word typewriter is disclosed. An entire syllable is typed by simultaneously pressing a chord of keys on a keyboard. The chord of keys is decoded according to certain decoding rules and priority rules. The invention produces an output of written text in standard format. The invention produces an output in standard format like a conventional typewriter, but at a speed which is faster than a conventional shorthand machine. A butterfly-shaped keyboard is used which has a center group of vowel keys. Eleven of the most frequently used consonants are placed on either side of the vowel keys, which are arranged in mirror images of each other. Less frequently used letters which are missing from the keyboard are formed by simultaneously pressing two keys.

22 Claims, 45 Drawing Sheets

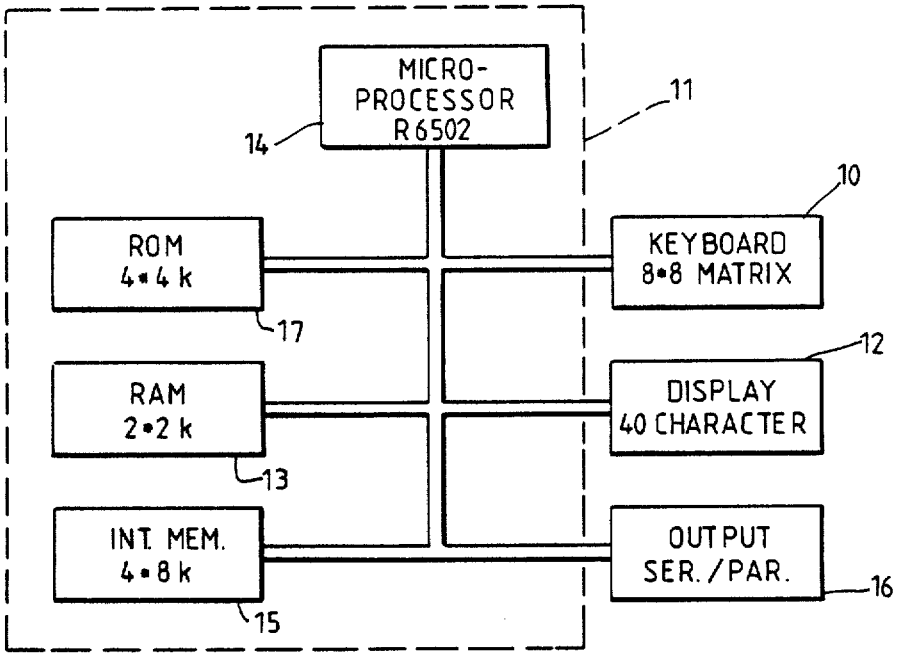
Fig. 3
Fig. 5
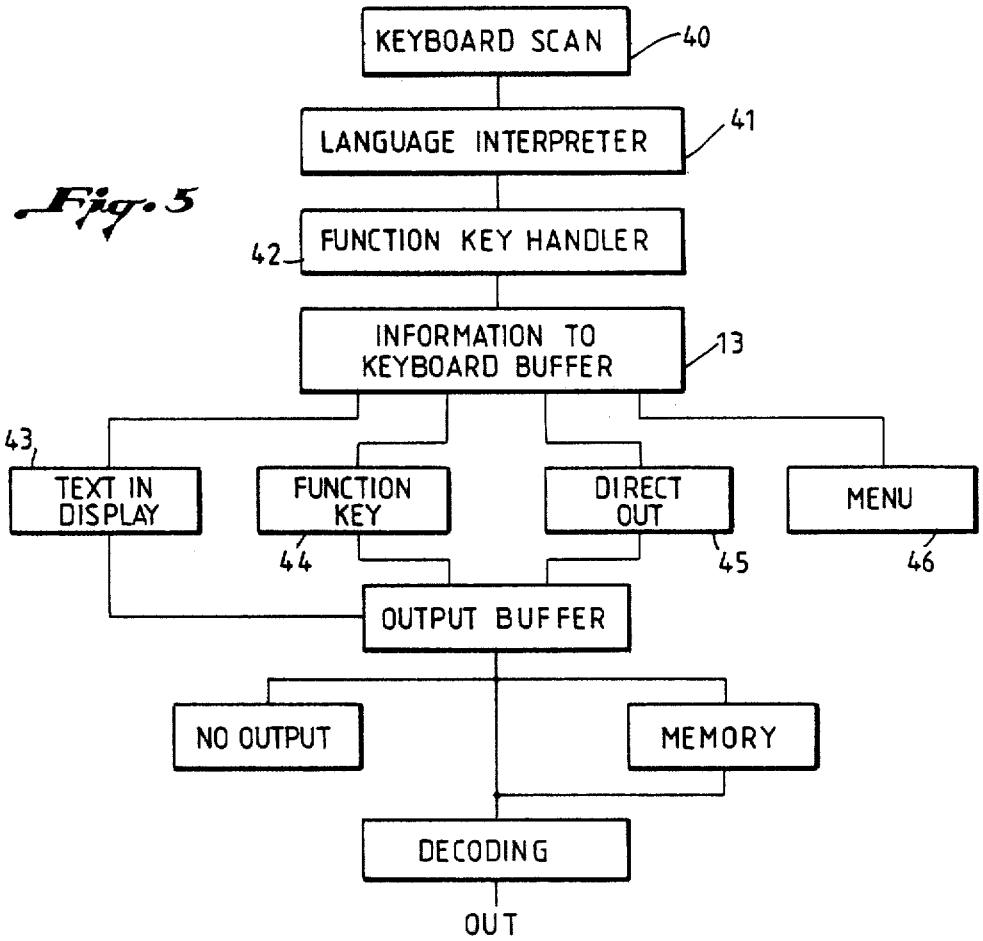

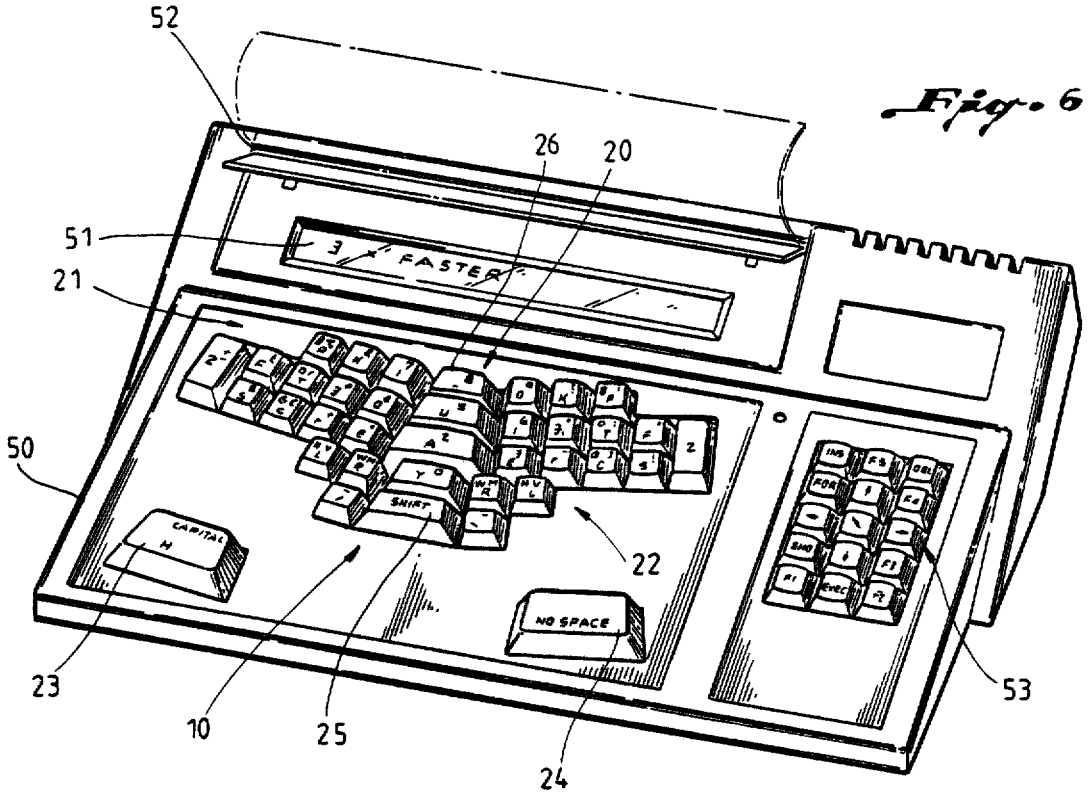
Fig. 6
Fig. 4
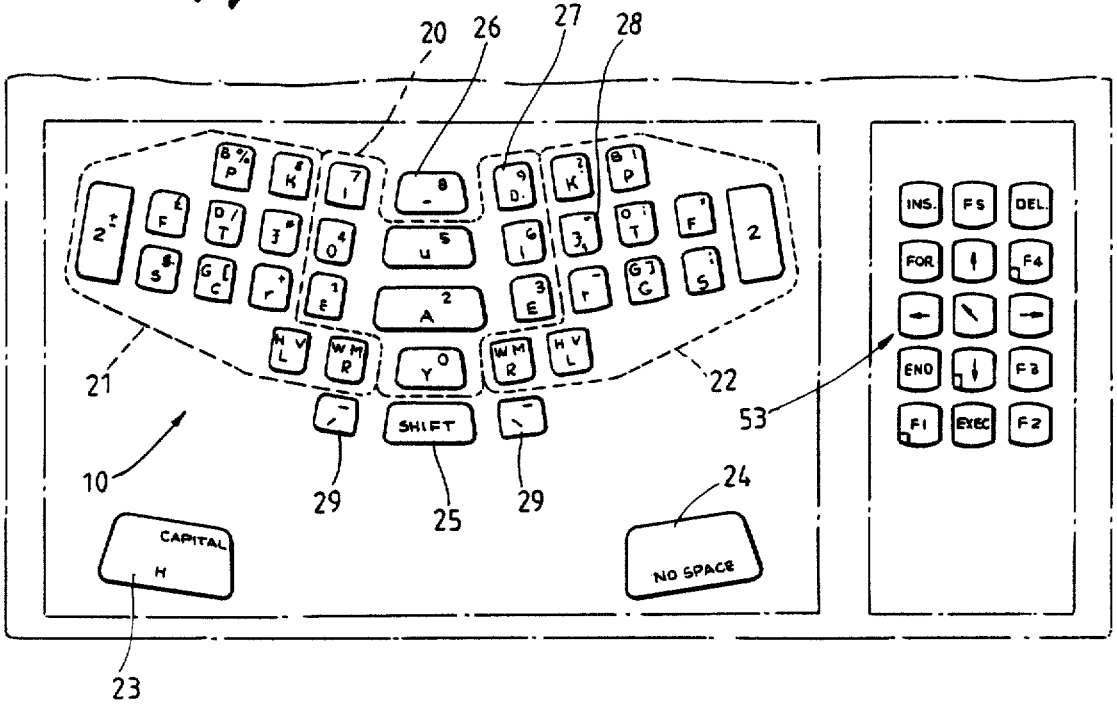

LANGUAGE FLOWCHARTS

```
BLOCK I FLOWCHART
-LEFT HAND CONSONANTS-
-DUTCH ENGLISH-

res= RESET KEY DOWN CONDITION OF CORRESPONDING KEY
sc = SET CONDITION BIT OF CORRESPONDING KEY
c  = TEST CONDITION BIT OF CORRESPONDING KEY
FIN= END OF BLOCK PROCESSING

ASM1;

T10     Z--K(res)---OUT=X---------------------!
        #  #                                  !
        !  ---P(res)------OUT=P---OUT=S-------!
        !     #                               !
        !     ---T(res)---OUT=T---OUT=S-------!
        !        #                            !
        !        ---------C(res)--OUT=Cc------!
        !                 #                   !
        !                 ----C(sc)---OUT=Z---!
        !                                     !
        !-------<-----------<------------<-----
        !
T20     S--LANG=E---XP9...19---OUT=A---!
        #    #                         !
        !    --C(sc)---OUT=S---->------!
        !                              !
        !---<------<-------<-------<----
        !
T30     P--J(res)--Z(sc)---OUT=B-----!
        #  #                         !
        !  ----S(sc)---OUT=P---->----+--->>> T60
        !
T40     C--J(res)---Z(sc)---OUT=G-------->>> T60
        # #
        !  ---K---S(sc)---OUT=K---------->>> T60
        !     #
        !     ---N--------OUT=G---------->>> T60
        !        #
        !        ----XP00---LANG=N---C(sc)---OUT=K--->>> T60
        !             #       #
        !             !       ---OUT=QU-----*FIN*
        !             !
        !             ---F(res)---OUT=Q---->----->---->>> T60
        !                #
        !                ---OUT=C---->----->----->---->>> T60
        !
```

FIG.8A

LANGUAGE FLOWCHARTS

```
        |
T50     T--C(sc)---J(res)---L---R---Z(sc)---OUT=D----->------|
        #           #         #   #                          |
        |           |         |   ---P(sc)---OUT=T------>------|
        |           |         |                              |
        |           |         ---Z(sc)---OUT=D---->------>-----|
        |           |                                        |
        |           ---S(sc)---OUT=T----->------->------>-----|
        |---<--------------<----------------<------------<----
        |
T60     F--J(res)---Z(sc)---OUT=V--------|
        #  #                             |
        |  ---H(res)---OUT=W-------------|
        |     #                          |
        |     ---S(sc)---OUT=F-----------|
        |---<---------<-----------<-------
        |
T70     J--L(res)---OUT=H---*FIN*
        #  #
        |  ---H(res)---Z(sc)---OUT=W-------->>> T100
        |     #
        |     ---N(res)--------OUT=W------->>> T100
        |        #
        |        ---OUT=J---|
        |---<-------<--------
        |
T80     H---XP00---OUT=WH----*FIN*
        #    #
        |    ---OUT=H---|
        |---<-------<----
        |
T90     K--S(c)---OUT=R-----|
        #  #                |
        |  ---OUT=K---------|
        |---<--------<-------
        |
T100    L--P(c)---OUT=H-----------------*FIN*
        #  #
        |  ---R---C(c)---OUT=W----------*FIN*
        |     #   #
        |     |   ---OUT=V--------------*FIN*
        |     |
        |     ----OUT=L-----------------*FIN*
        |
T110    R--N---OUT=M--------------------*FIN*
        #  #
        |  ----OUT=R--------------------*FIN*
        |
T120    N--Z(c)---OUT=R-----------------*FIN*
        #  #
        |  -------OUT=N-----------------*FIN*
        |
      *FIN*
```

FIG. 8B

END OF BLOCK I.

LANGUAGE FLOWCHARTS

FLOWCHART BLOCK II
-VOWELS-
-DUTCH ENGLISHres= RESET KEY DOWN CONDITION OF CORRESPONDING KEY
sc = SET CONDITION BIT OF CORRESPONDING KEY
c = TEST CONDITION BIT OF CORRESPONDING KEY
FIN= END OF BLOCK PROCESSING.

ASM2;

```
T130    '---OUT='-¦
        #         ¦
        ¦         ¦
        --<----<---
        ¦
T140    Y---OUT=Y-¦
        #         ¦
        ¦         ¦
        --<---<----
        ¦
T150    O--i(res)--E(res)---OUT=OI------>------>>>T180
        #  #       #
        ¦  ¦       ---OUT=A---e(res)---OUT=A-----*FIN*
        ¦  ¦                  #
        ¦  ¦                  ------->----->-----*FIN*
        ¦  ---E(res)---A---OUT=U----->----->--->>>T180
        ¦     #        #
        ¦     ¦        ---XP06---OUT=EO--->---->>>T190
        ¦     ¦            #
        ¦     ¦            ------OUT=OO--->---->>>T180
        ¦     ¦
        ¦     ---XP06---I(res)---OUT=I--¦
        ¦         #     #               ¦
        ¦         ¦--<--+-------<-------
        ¦         ¦
        ¦         ---LANG=N---o---NKY3=0-#---OUT=o'---¦   voor,zo
        ¦              #      #     #                 ¦
        ¦              ¦      ¦     ---->------->-----+
        ¦              ¦      ¦                       ¦
        ¦              ¦      ¦                     OUT=o'
        ¦              ¦      ¦                       ¦
        ¦              ¦      ¦                     *FIN*
        ¦              --->---+---OUT=O---¦
        ¦----<-------<--------<-------<----
        ¦
```

FIG. 8C

LANGUAGE FLOWCHARTS

```
T160    I--OUT=I---i---OUT=J------>------->----*FIN*
        #           #
                    ---e---LANG=N---OUT=e"----->----*FIN*
                       #     #
                       --->--+--T(sc)---F(sc)---->>>T180

T170    E--LANG=N---e---i---n---NKY1=0----OUT=e'e'---*FIN*
        #     #       #   #   #     #
                                ---------->---OUT=Ee"----*FIN*
              +-->---+->-+---F(sc)---OUT=E---|
        |----<--------<------<------<--------

T180    A--OUT=A---NKY2=1---LANG=E---n(sc)---|     (any)
        #             #         #             |
        |------<-----+----<---+-------<-------

T190    U--OUT=U---LANG=N---e---OUT=U--------*FIN*
        #             #      #
                      |      |
        |--<------<--+---<---

T200    o--NKY2=1---OUT=dec point-------------------------|
        #    #                                            |
             ---LANG=E---NKY3=1---f(res)---OUT=FF---*FIN*  |
                  #         #      #              (off)   |
                  ---->----+--->--+---OUT=O---|           |
        |------<---------<-------<-------<----+---<-----<----

T210    i--T(sc)---LANG=E---NKY3=1---j-#------------------|
        #             #         #     |                  |
                      ---->----+--->--+---F(sc)---OUT=I----|
        |----<-----------------<------------------<--------

T220    e--J(sc)---OUT=E---|
        #                  |
        |---<---------<-----
      *FIN*
```

FIG. 8 D

END OF BLOCK II.

LANGUAGE FLOWCHARTS

```
FLOWCHART BLOCK III
-RIGHT HAND CONSONANTS-
-DUTCH-

res= RESET KEY DOWN CONDITION OF CORRESPONDING KEY
sc = SET CONDITION BIT OF CORRESPONDING KEY
c  = TEST CONDITION BIT OF CORRESPONDING KEY
FIN= END OF BLOCK PROCESSING


ASM3;

T300     j---XP01---XP08---------¦
         #    #       #          ¦
         ¦    ¦       ---p(sc)---¦
         ¦    ¦                  ¦
         ¦    ---H(sc)------>-----¦
         ¦-----<--------<---------
         ¦
     LANG=E--->>>ENGELS   (go to BLOCK III english)
         #
         ¦
T310     l---XP02------OUT=H--------J(res)---->>> T320
         #    #
         ¦    ---n---r--->------->------->-----¦
         ¦       #   #                          ¦
         ¦       ¦   -----OUT=RL----*FIN*       ¦
         ¦       ¦                              ¦
         ¦       ---r---OUT=V-------*FIN*       ¦
         ¦          #                           ¦
         ¦          ----->---------->----------+---OUT=L---¦
         ¦--------<----------<----------<---------<--------
         ¦
T320     r---n---XP04-#---j(res)---OUT=R---¦
         #   #    ¦                        ¦
         ¦   ¦    --->------->------->-----+---L(sc)---OUT=M--->>>T340
         ¦   ¦
         ¦   ---OUT=R---z---NKY3=2---OUT=N---*FIN*
         ¦               #     #
         ¦---<-----<----+--<---
         ¦
```

FIG. 8E

LANGUAGE FLOWCHARTS

```
T330    n---p---OUT=M----->--------->--------->--------->---------
        #   #
        |   ---XP02---j(res)---XP05---OUT=U---
        |       #     #         #              |
        |       |     |         ----->---->---+---L(sc)---OUT=W---
        |       --->--+---OUT=N---
        --------<---------<------+-----<--------<---------<-------

T340    c---H(c)---L(sc)---OUT=G------>--------->--------->----------
        #    #
        |    ---s---t---OUT=CHTS---*FIN*
        |       #   #
        |       |   ----OUT=SCH----*FIN*
        |       |
        |       ---z----->------->-------->-------
        |          #                              |
        |          ---r---OUT=K--->>>T380         |
        |             #                           |
        |             ------->--------->----------+--R(sc)---OUT=C---
        ------<---------<---------<-------<------<--------<----------

T350    k---R(c)---L(sc)---OUT=H------------
        #   #
        |   ---z(res)---OUT=X--->>>T390
        |      #
        |      ---p---OUT=R----->----->-----
        |         #
        |         ----OUT=K----->----->-----
        ------<----------<--------<---------

T360    p---L(sc)---H(c)---OUT=B---
        #           #
        |           ---OUT=P-------
        -------<--------<----------

T370    f---H(c)---t-#---OUT=V---*FIN*
        #   #       |
        |   --->---+-----OUT=F---
        -----<--------<----------

T380    s---XP04---L(sc)---OUT=DS---->>>T410
        #    #
        |    ---N(sc)---OUT=S---
        -----<--------<---------

T390    t---H(c)---L(sc)---OUT=D---
        #   #
        |   ---K(sc)---OUT=T-------
        -----<-------<-------<-----
```

FIG. 8F

LANGUAGE FLOWCHARTS

```
          |
T400      j---H(c)-#---NKY2=0---OUT=,--->------|
          #   |          #                     |
          |   |          ---T(c)---OUT=J-------|
          |   |             #                  |
          |   |             ---L(sc)---OUT=I---|
          |-<-+-----<--------<-------<----------
          |
T410      z---L(c)--------------OUT=T----*FIN*
          #   #
          |   ----K(c)----------OUT=S----*FIN*
          |        #
          |        ----R(c)-----OUT=H----*FIN*
          |             #
          |             ---N(c)---OUT=TS---*FIN*
          |                #
          |                -------OUT=Z----*FIN*
      *FIN*
```

FIG. 8G

END OF BLOCK III.

LANGUAGE FLOWCHARTS

FLOWCHART BLOCK III
-RIGHT HAND CONSONANTS-
-ENGLISHres= RESET KEY DOWN CONDITION OF CORRESPONDING KEY.
sc = SET CONDITION BIT OF CORRESPONDING KEY
c = TEST CONDITION BIT OF CORRESPONDING KEY
FIN= END OF BLOCK PROCESSING

FIG. 8H

```
ASM3;

ENGELS   |
         |
T3010    l---XP03---OUT=GH---z---OUT=T---+---*FIN
         #    #               #          |
         |    |               ------>-----|
         |    |
         |    ---XP02---j(res)---NKY3=2---OUT=LL---*FIN*
         |         #     #           #
         |         |     |           ---r---OUT=RL--->>>T3070
         |         |     |              #
         |         |     |              ---NKY3=3---z---OUT=LLS---*FIN*
         |         |     |                   #      #
         |         |     |                   --->---+--OUT=H-----------|
         |         |     |                                            |
         |         --->--+---r---K(sc)---n---OUT=WN--->>>T3070        |
         |                   #            #                           |
         |                   |            ---XP04---OUT=RLD--->>>T410 |
         |                   |                #                       |
         |                   |                ---OUT=V--->>>T3090      |
         |                   ---NKY3=2---z---OUT=LF---*FIN*           |
         |                        #      #                            |
         |                        --->---+---OUT=L---|                |
         |-----<--------<----------<---------<------+-------<---------
         |
T3020    r---n---j(res)---OUT=R---|
         #   #   #                |
         |   |   ---->------->----+---K(sc)---OUT=M--->>>T3040
         |   |
         |   ---OUT=R---z---NKY3=2---OUT=N---*FIN*
         |              #     #
         |---<-----<----+--<---
         |
```

LANGUAGE FLOWCHARTS

```
T3030   n---p---OUT=M----->--------->--------->--------->--------¦
        #   #                                                    ¦
        ¦   ---n(c)---OUT=N-------------------------------------¦
        ¦      #                                                 ¦
        ¦      ---p(c)---OUT=N------>--------->--------->--------¦
        ¦         #                                              ¦
        ¦         ---j(res)---OUT=W------>-------->------->------¦
        ¦            #                                           ¦
        ¦            ---c---z-#---f-#---OUT=GN--->>>T3070        ¦
        ¦               #   ¦     ¦                              ¦
        ¦               ----+-----+---OUT=N---¦                  ¦
        ¦------<-------<--------<---------<---+----<--------<------
        ¦
T3040   c---XP03---XP04---f---OUT=DGE---*FIN*
        #    #      #     #
        ¦    ¦      ------+---L(sc)---OUT=G------->---------->------¦
        ¦    ¦                                                      ¦
        ¦    ---k-#---s---t---OUT=CS---*FIN*                        ¦
        ¦       ¦     #   #                                        ¦
        ¦       ¦     ¦   ---OUT=SH----*FIN*                       ¦
        ¦       ¦     ¦                                            ¦
        ¦       --->--+---z---t---OUT=TCH---*FIN*                  ¦
        ¦                 #   #                                    ¦
        ¦                 ¦   ---R(sc)--->--+----OUT=C------->------¦
        ¦                 ¦                 ¦                      ¦
        ¦                 ---f------>-------¦                      ¦
        ¦                    #              ¦                      ¦
        ¦                    ---k----->-----¦                      ¦
        ¦                       #                                  ¦
        ¦                       ---r---OUT=K------->--------->------¦
        ¦                          #                               ¦
        ¦                          ---R(sc)---OUT=C---¦            ¦
        ¦-------<---------<---------<---------<-------+-------<------
        ¦
T3050   k---z(res)---OUT=X--->>>T3080
        #   #
        ¦   ---p---OUT=R---->-------->-----¦
        ¦      #                           ¦
        ¦      ---c-#---t(res)---OUT=CT----¦
        ¦         ¦     #                  ¦
        ¦         --->--+---OUT=K---->-----¦
        ¦-------<--------<---------<--------
        ¦
```

FIG. 81

LANGUAGE FLOWCHARTS

```
        ¦
T3060   p---H(c)---z---OUT=BLE---*FIN*
        #    #     #
        ¦    ¦     ---OUT=B----->-------->------¦
        ¦    ---OUT=P---t-#---L(sc)------>------¦
        ¦              ¦                         ¦
        ¦------<--------+-------<--------<-------
        ¦
T3070   s---XP04---OUT=DS--->>>T3090
        #    #
        ¦    ---OUT=S---NKY3=2---j---OUT=S---*FIN*
        ¦                 #      #
        ¦                 --->---+---N(sc)---¦
        ¦----<--------<--------<--------<-----
        ¦
T3080   t---H(c)---z---OUT=TH---*FIN*
        #   #      #
        ¦   ¦      ---OUT=D----¦
        ¦   ---K(sc)---OUT=T---¦
        ¦-----<---------<-------
        ¦
T3090   f---H(c)---NKY3=2---OUT=F---¦
        #   #        #              ¦
        ¦   ---->----+------>-------+---z---OUT=FT---*FIN*
        ¦                                #
        ¦                                ---NKY3=1---OUT=F---*FIN*
        ¦                                     #
        ¦                                     ---OUT=E---*FIN*
        ¦
T3100   j---H(c)-#---NKY2=0---OUT=,---->------>-------->---------¦
        #   ¦          #                                         ¦
        ¦-<--          ---K(sc)---n(c)---z---OUT=IES---*FIN*     ¦
        ¦                          #      #                      ¦
        ¦                          --->---+---OUT=Y---¦          ¦
        ¦------<--------<---------<-----------<------+-----<------
        ¦
        --->>>T410   (z-DUTCH)
```

FIG. 8J

END OF BLOCK III.

LANGUAGE FLOWCHARTS

BLOCK I FLOWCHART
-LEFT HAND CONSONANTS-
-GERMANres= RESET KEY DOWN CONDITION OF CORRESPONDING KEY
sc = SET CONDITION BIT OF CORRESPONDING KEY
c = TEST CONDITION BIT OF CORRESPONDING KEY
FIN= END OF BLOCK PROCESSING

DASM1;

FIG. 8K

```
T10     Z---K(res)---OUT=X--------------------¦
        #   #                                  ¦
        ¦   ---P(res)------OUT=PS------>-------¦
        ¦      #                               ¦
        ¦      ---S(res)---OUT=SZ------>-------¦
        ¦         #                            ¦
        ¦         ---T(res)---OUT=TS----->-----¦
        ¦            #                         ¦
        ¦            ---C(res)---OUT=Cc--->----+----->-----¦
        ¦               #                                  ¦
        ¦               ---NKY1=2---J---OUT=SS---*FIN*     ¦
        ¦                    #      #                      ¦
        ¦                    -------+--C(sc)---OUT=Z--->---¦
        ¦--------<-----------<----------<---------<---------
        ¦
T20     S---C(sc)---C---T---J(res)---OUT=D---¦
        #           #   #   #                ¦
        ¦           ¦   ¦   ---OUT=T---¦     ¦
        ¦           ¦   ------>---->----+-->--+---T(sc)
        ¦           ¦                                ¦
        ¦           ¦                              OUT=SCH--->>>T60
        ¦           ¦
        ¦           ---OUT=S---NKY1=1---I(sc)---*FIN*
        ¦                         #
        ¦----<------<------<------
        ¦
T30     P---S(sc)---J(res)--Z(sc)---OUT=B-----¦
        #           #                         ¦
        ¦           ------>-----OUT=P---->----+--->>> T60
        ¦
```

LANGUAGE FLOWCHARTS

```
T40     C-- J(res)---S(sc)---Z(sc)---OUT=G-------->>> T60
        #   #
            ---K---S(sc)---OUT=K---------->>> T60
                #
                ---N--------OUT=G---------->>> T60
                    #
                    ---EXP00---OUT=QU---*FIN*
                         #
                         ---F(res)---OUT=Q----->>> T60
                            #
                            ---OUT=C----->----->>> T60

T50     T---C(sc)---J(res)---L---R---Z(sc)---OUT=D------------
        #           #        #   #                           |
                    |        |   ---P(sc)---OUT=T-------------|
                    |        |                                |
                    |        ---Z(sc)---OUT=D----------------|
                    |                                        |
                    ---S(sc)---OUT=T-------------------------|
        ----<--------------<----------------<------------<----

T60     F---S(sc)---J(res)---Z(sc)---OUT=V--------|
        #           #                             |
                    ---H(res)---OUT=W-------------|
                       #                          |
                       ----->-----OUT=F-----------|
        ----<---------<---------<---------<-------

T70     J---L(res)---OUT=H---*FIN*
        #   #
            ---H(res)---Z(sc)---OUT=W---->>> T100
                #
                ---N(res)--------OUT=W---->>> T100
                    #
                    ---OUT=J---|
        ----<-------<--------

T80     H---EXP00---OUT=WH---->----*FIN*
        #     #
              ---R(res)---OUT=RH---*FIN*
                 #
                 ---T(c)-#---OUT=H---|
                         |           |
        -----<-----+-------<---------
```

FIG. 8L

LANGUAGE FLOWCHARTS

```
          |
T90       K---S(c)---OUT=R-----|
          #   #                |
          |   ---OUT=K---------|
          |----<--------<-------
          |
T100      L---P(c)---OUT=H----->------>----*FIN*
          #   #
          |   ---R---C(c)---OUT=W----->----*FIN*
          |       #   #
          |       |   ---OUT=V---->----->---*FIN*
          |       |
          |       ----OUT=L---->-------->---*FIN*
          |
T110      R---N---OUT=M------>-------->----*FIN*
          #   #
          |   ----OUT=R------>-------->----*FIN*
          |
T120      N---Z(c)---OUT=R--->-------->----*FIN*
          #   #
          |   -------OUT=N--->-------->----*FIN*
          |
        *FIN*
```

END OF BLOCK I.

FIG. 8M

LANGUAGE FLOWCHARTS

```
FLOWCHART BLOCK II
-VOWELS-
-GERMAN-

res= RESET KEY DOWN CONDITION OF CORRESPONDING KEY
sc = SET CONDITION BIT OF CORRESPONDING KEY
c  = TEST CONDITION BIT OF CORRESPONDING KEY
FIN= END OF BLOCK PROCESSING.

DASM2;

T200    '---OUT='-¦
        #         ¦
        ¦         ¦
        --<----<---
        ¦
T210    Y---OUT=Y-¦
        #         ¦
        ¦         ¦
        --<---<----
        ¦
T220    O---i(res)--E(res)---OUT=OI------>------>>>T250
        #   #       #
        ¦   ¦       ---e(res)---OUT=A---¦
        ¦   ¦          #                ¦
        ¦   ¦          ---->------>-----+---OUT=A--->>>T250
        ¦   ¦
        ¦   ---E(res)---A---OUT=U----->----->--->>>T250
        ¦       #       #
        ¦       ¦       ---XP06---OUT=EO--->---->>>T260
        ¦       ¦           #
        ¦       ¦           ---e(res)---OUT=O"H---*FIN*
        ¦       ¦              #
        ¦       ¦              ---OUT=OH---*FIN*
        ¦       ¦
        ¦       ---XP06---I---OUT=IO--->>>T250
        ¦           #     #
        ¦           --->--+---e(res)---OUT=O"--->>>T250
        ¦                    #
        ¦                    ---OUT=O---->----->>>T250
        ¦
T230    I---OUT=I---i---e---OUT=E---¦
        #           #   #           ¦
        ¦           ¦   ---->---->---+---OUT=H---*FIN*
        ¦           ¦
        ¦           --->>>T250
        ¦
```

FIG. 8N

LANGUAGE FLOWCHARTS

```
        |
T240    E---OUT=E---i---e---OUT=IH---*FIN*
        #            #   #
        |            -->-+---NKY2=1---e(sc)---*FIN*
        |                         #
        |-----<---------<------
        |
T250    A---e(res)---OUT=A"---|
        #   #                 |
        |   ---OUT=A----->----+---NKY2=1---e(sc)---*FIN*
        |                             #
        |----<--------<--------<-----
        |
T260    U---e(res)---OUT=U"---|
        #   #                 |
        |   ---OUT=U---->-----+---i---OUT=H---*FIN*
        |                           #
        |----<-------<------<------
        |
T270    o---NKY2=1---OUT=dec point---*FIN*
        #     #
        |     ---OUT=O---|
        |----<------<-----
        |
T280    i---OUT=I---|
        #           |
        |----<-------
        |
T290    e---OUT=E---NKY2=1---I(c)---E(sc)---|      (selbst)
        #              #      #               |
        |------<------+---<--+---<------<----
        |
      *FIN*
```

FIG. 80

END OF BLOCK II.

LANGUAGE FLOWCHARTS

FLOWCHART BLOCK III
-RIGHT HAND CONSONANTS-
-GERMANres= RESET KEY DOWN CONDITION OF CORRESPONDING KEY
sc = SET CONDITION BIT OF CORRESPONDING KEY
c  = TEST CONDITION BIT OF CORRESPONDING KEY
FIN= END OF BLOCK PROCESSING

DASM3;

```
***      e(c)---OUT=H---¦  extra H if condition e true
         #              ¦
         ¦------<--------
         ¦
T300     l---r---n---OUT=LM--->>>T370
         #   #   #
         ¦   ¦   ---XP04---OUT=RLD---*FIN*
         ¦   ¦       #
         ¦   ¦       ---OUT=V--->>>T330
         ¦   ¦
         ¦   ---OUT=L---j---c--->>>T330
         ¦               #   #
         ¦               ¦   ---p--->>>T330
         ¦               ¦       #
         ¦               ¦       ---XP04--->>>T370
         ¦               ¦           #
         ¦               ------>-----+---j(res)---L(sc)---OUT=L--->>>T370
         ¦                               #
         ¦                               ---E(c)---s---t---OUT=BST---*FIN*
         ¦                                  #       #   #
         ¦-----<---------<---------<------+--<---+-<--
         ¦
```

FIG. 8P

LANGUAGE FLOWCHARTS

```
        |
T310    r---n---OUT=M---|
        #   #           |
        |   |           ---XP04---K(sc)---OUT=D--->>>T400
        |   |               #
        |   |               ---j(res)---L(sc)---OUT=M--->>>T340
        |   |                  #
        |   |                  ---z---OUT=MT---*FIN*
        |   |                     #
        |   |                     --->>>T330
        |   ---OUT=R---XP04--->>>T370
        |               #
        |               ---j---c--->>>T330
        |                  #   #
        |                  |   ---p--->>>T330
        |                  |      #
        |                  --->---+---j(res)---L(sc)---OUT=R--->>>T370
        |                         #
        |----<-------<--------<--------
        |
T320    n---p---k---L(sc)---OUT=RM--->>>T370
        #   #   #
        |   |   ---OUT=M--->>>T350
        |   |
        |   ---OUT=N---XP04--->>>T370
        |               #
        |               ---j(res)---L(sc)---c---OUT=G--->>>T370
        |                  #                #
        |-----<-------<-----                ---OUT=N---->>>T370
        |
```

FIG. 8Q

LANGUAGE FLOWCHARTS

```
T330   c---j(res)---L(sc)---OUT=G---------->--------->------------
       #   #
       ---s---t---OUT=CHTS---*FIN*
           #   #
           ---k---OUT=CHS---*FIN*
               #
               ---OUT=SCH----*FIN*

       ---k(res)---OUT=CK---z---OUT=S---*FIN*
           #                 #
           ---<------<-------

           ---z---t---OUT=TSCH---*FIN*
               #   #
               ---OUT=CHT---*FIN*
               ---f---OUT=CH----*FIN*
                   #
                   ---r---OUT=K---->-------->-------->---------
                       #
                       ---t(res)---K(sc)---OUT=TT--->>>T400
                           #
                           ---OUT=C---
       ----<-------<-------<------<----+----<--------<------------

T340   k---p---L(sc)---OUT=RN--->>>T400
       #   #
       ---z---OUT=X---t---OUT=T---
           #           #
           ----->----->--+---*FIN*

       ---I---NKY2=1---OUT=CH---t---OUT=T---s---OUT=S---
           #     #               #           #
           ---->--+---OUT=K---
       ------<----------<----------

T350   p---j(res)---OUT=B---s-#---t---K(sc)---OUT=D--->>>T400
       #   #                  #     #
           ---->>>T370              ------>----
                                                 ---OUT=P--->----->-------->------+---z---OUT=T---
                                                                                  #
       --------<--------<---------<--------<---+---<-----<-
```

FIG. 8R

LANGUAGE FLOWCHARTS

```
T360    f---z(res)---OUT=W---->------->------>--¦
        #   #                                   ¦
        ¦   ---OUT=F---j(res)---L(sc)---OUT=F---¦
        ¦                #                      ¦
        ¦----<-----<---+---<-------<-------<-----
        ¦
T370    s---XP04---XP07---OUT=TS---*FIN*
        #    #      #
        ¦    ¦      ---->--OUT=DS---*FIN*
        ¦    ¦
        ¦    ---j(res)---L(sc)---OUT=Ss---¦
        ¦       #                         ¦
        ¦       ---N(sc)---OUT=S----->----¦
        ¦-----<--------<-------<------<----
        ¦
T380    t---j(res)---z---OUT=DT---*FIN*
        #   #        #
        ¦   ¦        ---OUT=D---*FIN*
        ¦   ---R(sc)---OUT=T---¦
        ¦----<------<------<----
        ¦
T390    j---NKY2=0---OUT=,--->---->---¦
        #     #                       ¦
        ¦     ---z---OUT=Ss---OUT=t---¦
        ¦        #                    ¦
        ¦        ---OUT=j---¦         ¦
        ¦---<-----<---------+----<-----
        ¦
T400    z---NKY4=1---NKY3=1---I---OUT=Z---*FIN*
        #     #        #      #
        ¦     ¦        ¦      ---OUT=TZ---*FIN*
        ¦     ¦        ¦
        ¦     ¦        ---NKY3=2---R(c)---OUT=ZT---*FIN*
        ¦     ¦             #      #
        ¦     ¦----<-----<--+--<----
        ¦     ¦
        ¦     ---L(c)---OUT=T---*FIN*
        ¦        #
        ¦        ----K(c)---OUT=S---*FIN*
        ¦            #
        ¦            ---N(c)---OUT=TS---*FIN*
        ¦               #
        ¦               ---OUT=Z---*FIN*
      *FIN*
```

FIG. 8S

END OF BLOCK III.

LANGUAGE SOURCE CODE

```
Language: Dutch and English
Group   : I  Left hand consonants

* Date: 09-05-1984 *

* ASM1 *

* T10 *

IF K-Z- THEN
   IF R-K- THEN O-x- ;
   ELSE IF R-P- THEN O-p- O-s- ;
        ELSE IF R-T- THEN
                     O-t- O-s- ;
             ELSE IF R-C- THEN
                          H-DB- ;
                  ELSE S-C- O-z-
ELSE ;

* T20 *

IF K-S- THEN
  IF L=E THEN
    IF NOT X9 THEN
     IF NOT X10 THEN
      IF NOT X11 THEN
       IF NOT X12 THEN
        IF NOT X13 THEN
         IF NOT X14 THEN
          IF NOT X15 THEN
           IF NOT X16 THEN
            IF NOT X17 THEN
             IF NOT X18 THEN
               IF NOT X19 THEN
                           J T21
               ELSE
             ELSE
            ELSE
           ELSE
          ELSE
         ELSE
        ELSE
       ELSE
      ELSE
     ELSE
    ELSE O-a- ; * along,enz. *
.T21
      S-C- O-s-
ELSE ;
```

FIG. 9A

LANGUAGE SOURCE CODE

```
* T30 *

IF K-P- THEN S-S-
    IF R-J- THEN S-Z- O-b- J T60
    ELSE O-p- J T60
ELSE ;

* T40 *

IF K-C- THEN
   IF R-J- THEN
           S-S- S-Z- O-g- J T60
   ELSE IF K-K- THEN
                S-S- O-k- J T60
        ELSE IF K-N- THEN
                     O-g- J T60
             ELSE IF X0 *RL* THEN
                    IF L=N THEN
                          S-C- O-k- J T60
                    ELSE  $-qu- FIN
                ELSE IF R-F- THEN
                      O-q- J T60
                 ELSE O-c- J T60
ELSE ;

* T50 *

IF K-T- THEN S-C-
   IF R-J- THEN
      IF K-L- THEN
         IF K-R- THEN S-Z- O-d- ;
         ELSE S-P- O-t- ;
      ELSE S-Z- O-d- ;
   ELSE S-S- O-t-
ELSE ;

* T60 *

.T60
IF K-F- THEN
   IF R-J- THEN S-Z- O-v- ;
   ELSE IF R-H- THEN O-w- ;
        ELSE S-S- O-f-
ELSE ;
```

FIG. 9B

LANGUAGE SOURCE CODE

```
* T70 *
IF K-J- THEN
   IF R-L- THEN O-h- FIN
   ELSE IF R-H- THEN
                S-Z- O-w- J T100
        ELSE
         IF R-N- THEN O-w- J T100
         ELSE O-j-
ELSE ;

* T80 *

IF K-H- THEN
   IF X0 *RL* THEN $-wh- FIN
   ELSE O-h-
ELSE ;

* T90 *

IF K-K- THEN
   IF C-S- THEN O-r- ;
   ELSE O-k-
ELSE ;

* T100 *

.T100
IF K-L- THEN
   IF C-P- THEN O-h- ;
   ELSE IF K-R- THEN
           IF C-C- THEN O-w- ;
           ELSE O-v- ;
        ELSE O-l- ;
ELSE J T110 ;
FIN

* T110 *
.T110
IF K-R- THEN
   IF K-N- THEN O-m- FIN
   ELSE O-r- FIN
ELSE ;

* T120 *

IF K-N- THEN
   IF C-Z- THEN O-r- ;
   ELSE O-n-
ELSE ;
FIN

END
```

FIG. 9C

LANGUAGE SOURCE CODE

```
Language: Dutch and English
Group   : II Vowels

* Date: 09-05-1984 *

* ASM2 *

* T130 *
IF K-'- THEN O-'- ELSE

* T140 *
IF K-Y- THEN O-y- ELSE ;

* T150 *
IF K-O- THEN
  IF R-i- THEN
    IF R-E- THEN O-o- O-i- J T180
    ELSE O-a- IF R-e-
                 THEN O-a-
              ELSE FIN
  ELSE IF R-E- THEN
         IF K-A- THEN O-u- J T180
         ELSE IF X6 THEN
                O-e- O-o- J T190
              ELSE O-o- O-o-
                           J T180
       ELSE IF X6 THEN
              IF R-I- THEN O-i-
              ELSE
            ELSE
            IF L=N THEN
              IF K-o- THEN
                IF NOT Y3=0 THEN H-CF-
                ELSE H-CF- FIN
            ELSE O-o-
ELSE ;

* T160 *
IF K-I- THEN O-i-
        IF K-i- THEN O-j- FIN
        ELSE IF K-e- THEN
               IF L=N THEN
                        H-C8- FIN
             ELSE S-T- S-F- J T180
ELSE ;
```

FIG. 9D

LANGUAGE SOURCE CODE

```
* T170 *
IF K-E- THEN
  IF L=N THEN
    IF K-e- THEN
      IF K-i- THEN
        IF K-n- THEN
          IF Y1=0 THEN
                  H-C5- H-C5- FIN
          ELSE
        ELSE O-e- H-C8- FIN
      ELSE
    ELSE
  ELSE S-F- O-e-
ELSE ;

* T180 *
.T180 IF K-A- THEN O-a-
        IF Y2=1 THEN
          IF L=E THEN S-n-  * any *
          ELSE
        ELSE
      ELSE ;

* T190 *
.T190 IF K-U- THEN O-u-
        IF L=N THEN
          IF K-e- THEN O-u- FIN
          ELSE
        ELSE
      ELSE ;

* T200 *
IF K-o- THEN
  IF Y2=1 THEN O-.- ;
  ELSE IF L=E THEN
         IF Y3=1 THEN
           IF R-f- THEN $-ff- FIN  * off *
           ELSE
         ELSE
       ELSE O-o-
ELSE ;

* T210 *
IF K-i- THEN S-T-
  IF L=E THEN
    IF Y3=1 THEN
      IF NOT K-j- THEN ;
      ELSE
    ELSE
  ELSE S-F- O-i-
ELSE ;

* T220 *
IF K-e- THEN S-J- O-e-
ELSE ;
FIN
END
```

FIG. 9E

LANGUAGE SOURCE CODE

```
Language: Dutch
Group   : III  Right hand consonants

* Date: 10-05-1984 *

* NASM3 *

* T300 *
IF K-j- THEN IF NOT X1 THEN
                          S-H-
             ELSE IF NOT X8 THEN
                          S-p-
                  ELSE
ELSE ;

IF L=E THEN JL ENGELS
ELSE ;

* T310 *
IF K-l- THEN
  IF X2 THEN
    IF R-j- THEN
    ELSE O-h- ;
  ELSE IF K-n- THEN
          IF K-r- THEN J T311
          ELSE $-rl- FIN
       ELSE IF K-r- THEN
                  O-v- FIN
      .T311 ELSE O-l-
ELSE ;

* T320 *
.T320
IF K-r- THEN
  IF K-n- THEN
    IF NOT X4 * jt * THEN
      IF R-j- THEN O-r-
      ELSE
    ELSE S-L- O-m- J T340
  ELSE O-r-
  IF K-z- THEN
    IF Y3=2 THEN O-n- FIN
    ELSE
  ELSE
ELSE ;
```

FIG. 9F

LANGUAGE SOURCE CODE

```
* T330 *
IF K-n- THEN
  IF K-p- THEN O-m- ;
  ELSE IF X2 THEN
          IF R-j- THEN
            IF X5 THEN O-u-
            ELSE S-L- O-w- ;
          ELSE
        ELSE O-n-
ELSE ;

* T340 *
.T340
IF K-c- THEN
  IF C-H- THEN S-L- O-g- ;
  ELSE IF K-s- THEN
          IF K-t- THEN $-chts- FIN
          ELSE $-sch- FIN
        ELSE IF K-z- THEN J T341
             ELSE IF K-r- THEN
                  O-k- J T380
            .T341 ELSE S-R- O-c-
ELSE ;

* T350 *
IF K-k- THEN
  IF C-R- THEN S-L- O-h- ;
  ELSE IF R-z- THEN
                O-x- J T390
        ELSE IF K-p- THEN
                O-r- ;
             ELSE O-k-
ELSE ;

* T360 *
IF K-p- THEN S-L-
  IF C-H- THEN O-b- ;
  ELSE O-p-
ELSE ;

* T370 *
IF K-f- THEN
  IF C-H- THEN
    IF NOT K-t- THEN O-v- FIN
    ELSE
  ELSE O-f-
ELSE ;
```

FIG. 9G

LANGUAGE SOURCE CODE

```
* T380 *
.T380
IF K-s- THEN
  IF X4 THEN
          S-L- O-d- O-s- J T410
  ELSE S-N- O-s-
ELSE ;

* T390 *
.T390
IF K-t- THEN
  IF C-H- THEN S-L- O-d- ;
  ELSE S-K- O-t-
ELSE ;

* T400 *
IF K-j- THEN
  IF NOT C-H- THEN
    IF Y2=0 THEN O-,- ;
    ELSE IF C-T- THEN O-j- ;
         ELSE S-L- O-i- ;
  ELSE
ELSE ;

* T410 *
.T410
IF K-z- THEN
  IF C-L- THEN O-t- FIN
  ELSE IF C-K- THEN O-s- FIN
       ELSE IF C-R- THEN O-h- FIN
            ELSE IF C-N- THEN
                         $-ts- FIN
                 ELSE O-z-
ELSE ;
FIN
END
```

FIG. 9H

LANGUAGE SOURCE CODE

```
Language: English
Group   : III  Right hand consonants

* Date: 10-05-1984 *

* EASM3 *

.ENGELS

* T3010 *
IF K-l- THEN
  IF X3 THEN $-gh-
    IF K-z- THEN O-t-
    ELSE FIN
  ELSE
  IF X2 THEN
    IF R-j- THEN
      IF Y3=2 THEN $-ll- FIN
      ELSE IF K-r- THEN
                $-rl- JL T3070
            ELSE IF Y3=3 THEN
                    IF K-z- THEN
                       $-lls- FIN
                    ELSE
                  ELSE O-h- ;
    ELSE
  ELSE
    IF K-r- THEN S-K-
      IF K-n- THEN $-wn- JL T3070
      ELSE IF X4 *jt* THEN
                  $-rld- J T410
            ELSE O-v- JL T3090
    ELSE IF Y3=2 THEN
            IF K-z- THEN
                 $-lf- FIN
            ELSE
          ELSE O-l-
ELSE ;
```

FIG. 91

LANGUAGE SOURCE CODE

```
* T3020 *
IF K-r- THEN
  IF K-n- THEN
    IF R-j- THEN O-r-
    ELSE S-K- O-m- J T3040
  ELSE O-r-
  IF K-z- THEN
    IF Y3=2 THEN O-n- FIN
    ELSE
  ELSE
ELSE ;

* T3030 *
IF K-n- THEN
  IF K-p- THEN O-m- ;
  ELSE IF C-n- THEN O-n- ;
       ELSE
       IF C-p- THEN O-n- ;
       ELSE IF R-j- THEN O-w- ;
            ELSE
            IF K-c- THEN
              IF NOT K-z- THEN
                IF NOT K-f- THEN
                  O-g- O-n- J T3070
                ELSE
              ELSE
            ELSE O-n-
ELSE ;
```

FIG. 9 J

LANGUAGE SOURCE CODE

```
* T3040 *
.T3040
IF K-c- THEN
  IF X3 THEN   * cj *
    IF X4 THEN * jt *
      IF K-f- THEN $-dge- FIN
      ELSE
    ELSE S-L- O-g- ;
  ELSE IF NOT K-k- THEN
         IF K-s- THEN
           IF K-t- THEN $-cs- FIN
           ELSE $-sh- FIN
         ELSE
       ELSE IF K-z- THEN
                IF K-t- THEN
                    $-tch- FIN
                ELSE
         .T3041 S-R- O-c- ;
            ELSE IF K-f- THEN
                    O-c- ;
                 ELSE
                 IF K-k- THEN
                    O-c- ;
                 ELSE
                 IF K-r- THEN
                    O-k- ;
                 ELSE J T3041
ELSE ;

* T3050 *
IF K-k- THEN
  IF R-z- THEN O-x- J T3080
  ELSE IF K-p- THEN
          O-r- ;
       ELSE IF NOT K-c- THEN
               IF R-t- THEN
                 O-c- O-t- ;
               ELSE
            ELSE O-k-
ELSE ;
```

FIG. 9K

LANGUAGE SOURCE CODE

```
* T3060 *
IF K-p- THEN
  IF C-H- THEN
    IF K-z- THEN $-ble- FIN
    ELSE O-b- ;
  ELSE O-p-
  IF NOT K-t- THEN S-L-
  ELSE
ELSE ;

* T3070 *
.T3070
IF K-s- THEN
  IF X4 THEN O-d- O-s- J T3090
  ELSE O-s-
  IF Y3=2 THEN
    IF K-j- THEN O-s- FIN
    ELSE
  ELSE S-N-
ELSE ;

* T3080 *
.T3080
IF K-t- THEN
  IF C-H- THEN
    IF K-z- THEN $-th- FIN
    ELSE O-d- ;
  ELSE S-K- O-t-
ELSE ;

* T3090 *
.T3090
IF K-f- THEN
  IF C-H- THEN
    IF Y3=2 THEN
        O-f-
    ELSE
  ELSE IF K-z- THEN $-ft- FIN
       ELSE IF Y3=1 THEN O-f- FIN
            ELSE O-e- FIN
ELSE ;

* T3100 *
IF K-j- THEN
  IF NOT C-H- THEN
    IF Y2=0 THEN O-,- ;
    ELSE S-K-
    IF C-n- THEN
      IF K-z- THEN $-ies- FIN
      ELSE
    ELSE O-y-
  ELSE
ELSE ;

JL T410  *goto z Dutch *

END
```

FIG. 9L

LANGUAGE SOURCE CODE

```
Language: German
Group   : I  Left hand consonants

* Date: 27-04-1984 *

* DASM1 *

* T10 *

IF K-Z- THEN
   IF R-K- THEN O-x- ;
   ELSE IF R-P- THEN O-p- O-s- ;
        ELSE IF R-S- THEN
                O-s- O-z- ;
             ELSE IF R-T- THEN
                     O-t- O-s- ;
                  ELSE
                  IF R-C- THEN
                          H-DB- ;
                  ELSE S-C- O-z-
ELSE ;

* T20 *

IF K-S- THEN S-C-
   IF  K-C-  THEN
     IF K-T- THEN
       IF R-J- THEN O-d- J T21
       ELSE O-t-
.T21 ELSE S-T- $-sch- J T60
   ELSE O-s-
   IF Y1=1 THEN S-I- FIN
   ELSE
ELSE ;

* T30 *

IF K-P- THEN
    IF R-J- THEN S-Z- O-b- J T60
    ELSE S-S- O-p- J T60
ELSE ;
```

FIG. 9M

LANGUAGE SOURCE CODE

```
* T40 *

IF K-C- THEN
   IF R-J- THEN S-Z- O-g- J T60
   ELSE IF K-K- THEN
                S-S- O-k- J T60
        ELSE IF K-N- THEN
                     O-g- J T60
             ELSE IF X0 THEN
                    $-qu- FIN
                  ELSE
                  IF R-F- THEN O-q- J T60
                  ELSE O-c- J T60
ELSE ;

* T50 *
.T50
IF K-T- THEN S-C-
   IF R-J- THEN
      IF K-L- THEN
         IF K-R- THEN S-Z- O-d- ;
         ELSE S-P- O-t- ;
      ELSE S-Z- O-d- ;
   ELSE S-S- O-t-
ELSE ;

* T60 *

.T60
IF K-F- THEN
   IF R-J- THEN S-Z- O-v- ;
   ELSE IF R-H- THEN O-w- ;
        ELSE S-S- O-f-
ELSE ;

* T70 *

IF K-J- THEN
   IF R-L- THEN O-h- FIN
   ELSE IF R-H- THEN
                S-Z- O-w- J T100
        ELSE
        IF R-N- THEN O-w- J T100
        ELSE O-j-
ELSE ;
```

FIG. 9N

LANGUAGE SOURCE CODE

```
* T80 *

IF K-H- THEN
   IF X0 THEN $-wh- FIN
   ELSE IF R-R- THEN $-rh- FIN
        ELSE
        IF NOT C-T- THEN O-h-
        ELSE
ELSE ;

* T90 *

IF K-K- THEN
   IF C-S- THEN O-r- ;
   ELSE O-k-
ELSE ;

* T100 *

.T100
IF K-L- THEN
   IF C-P- THEN O-h- ;
   ELSE IF K-R- THEN
            IF C-C- THEN O-w- ;
            ELSE O-v- ;
        ELSE O-l- ;
ELSE J T110 ;
FIN

* T110 *
.T110
IF K-R- THEN
   IF K-N- THEN O-m- FIN
   ELSE O-r- FIN
ELSE ;

* T120 *

IF K-N- THEN
   IF C-Z- THEN O-r- ;
   ELSE O-n-
ELSE ;
FIN

END
```

FIG. 90

LANGUAGE SOURCE CODE

```
Language: German
Group   : II  Vowels

* Date: 27-04-1984 *

* DASM2 *

* T200 *
IF K-'- THEN O-'- ELSE ;

* T210 *
IF K-Y- THEN O-y- ELSE ;

* T220 *
IF K-O- THEN
  IF R-i- THEN
    IF R-E- THEN O-o- O-i- J T250
    ELSE IF R-e- THEN O-a-
         ELSE O-a- J T250
  ELSE IF R-E- THEN
         IF K-A- THEN O-u- J T250
         ELSE IF X6 THEN
            O-e- O-o- J T260
         ELSE IF R-e- THEN
            H-D2- O-h- FIN
              ELSE  $-oh- FIN
       ELSE IF X6 THEN
              IF K-I- THEN
                 O-i- O-o- J T250
              ELSE
            ELSE
        IF R-e- THEN H-D2- J T250
        ELSE O-o- J T250
ELSE ;

* T230 *
IF K-I- THEN O-i-
        IF K-i- THEN
           IF K-e- THEN O-e-
           ELSE O-h- FIN
        ELSE J T250
ELSE ;
```

FIG. 9P

LANGUAGE SOURCE CODE

```
* T240 *
IF K-E- THEN O-e-
   IF K-i- THEN
      IF K-e- THEN
         $-ih- FIN
      ELSE
   ELSE
   IF Y2=1 THEN O-h- FIN
   ELSE
ELSE ;

* T250 *
.T250
IF K-A- THEN
   IF R-e- THEN H-C4- J T251
   ELSE O-a-
.T251  IF Y2=1 THEN O-h- FIN
       ELSE IF R-U- THEN O-u-
            ELSE IF K-i- THEN
                    O-h- FIN
                 ELSE
ELSE ;

* T260 *
.T260 IF K-U- THEN
        IF R-e- THEN H-DB- J T261
        ELSE O-u-
.T261   IF K-i- THEN O-h- FIN
        ELSE
      ELSE ;

* T270 *
IF K-o- THEN
   IF Y2=1 THEN O-.- FIN
   ELSE O-o-
ELSE ;

* T280 *
IF K-i- THEN O-i-
ELSE ;

* T290 *
IF K-e- THEN O-e-
  IF Y2=1 THEN
    IF C-I- THEN S-E-  * SELBST *
    ELSE
  ELSE
ELSE ;

FIN
END
```

FIG. 9Q

LANGUAGE SOURCE CODE

```
Language: German
Group   : III  Right hand consonants

* Date: 18-05-1984 *

* DASM3 *

* T300 *
IF K-l- THEN
  IF K-r- THEN
    IF K-n- THEN
            $-lm- JL T370
    ELSE IF X4 THEN
            $-rld- FIN
          ELSE O-v- JL T330
  ELSE O-l-
  IF K-j- THEN
    IF K-c- THEN J T330
    ELSE
    IF K-p- THEN J T330
    ELSE
    IF X4 THEN JL T370A
    ELSE
  ELSE
    IF R-j- THEN S-L- O-l- JL T370
    ELSE IF C-E- THEN
            IF K-s- THEN
              IF K-t- THEN
* selbst *      $-bst- FIN
              ELSE
            ELSE
          ELSE
ELSE ;
```

FIG. 9R

LANGUAGE SOURCE CODE

```
* T310 *
IF K-r- THEN
   IF K-n- THEN O-m-
     IF X4 THEN S-K- O-d- JL T400
     ELSE IF R-j- THEN
             S-L- O-m- JL T340
          ELSE
          IF K-z- THEN
               $-mt- FIN
          ELSE J T330
   ELSE O-r-
   IF X4 THEN JL T370A
   ELSE
   IF K-j- THEN
     IF K-c- THEN J T330
     ELSE IF K-p- THEN J T330
          ELSE
   ELSE
   IF R-j- THEN S-L- O-r- JL T370
   ELSE
ELSE ;

* T320 *
IF K-n- THEN
  IF K-p- THEN
    IF K-k- THEN
            S-L- $-rm- JL T370
    ELSE O-m- JL T350
  ELSE O-n-
  IF X4 THEN JL T370A
  ELSE
  IF R-j- THEN S-L-
     IF K-c- THEN O-g- JL T370
     ELSE O-n- JL T370
  ELSE
ELSE ;
```

FIG. 9S

LANGUAGE SOURCE CODE

```
* T330 *
.T330
IF K-c- THEN
  IF R-j- THEN S-L- O-g- ;
  ELSE
  IF K-s- THEN
    IF K-t- THEN $-chts- FIN
    ELSE
    IF K-k- THEN $-chs- FIN
    ELSE $-sch- FIN
  ELSE
  IF R-k- THEN $-ck-
    IF K-z- THEN O-s- FIN
    ELSE ;
  ELSE
  IF K-z- THEN
    IF K-t- THEN $-tsch- FIN
    ELSE $-cht- FIN
  ELSE
  IF K-f- THEN $-ch- FIN
  ELSE
  IF K-r- THEN O-k- ;
  ELSE
  IF R-t- THEN S-K- $-tt- JL T400
  ELSE O-c-
ELSE ;

* T340 *
.T340
IF K-k- THEN
  IF K-p- THEN S-L- $-rn- JL T400
  ELSE
  IF K-z- THEN O-x-
    IF K-t- THEN O-t-
    ELSE FIN
  ELSE
  IF K-I- THEN
    IF Y2=1 THEN $-ch-
      IF K-t- THEN O-t-
        IF K-s- THEN O-s-
        ELSE
      ELSE FIN
    ELSE
  ELSE O-k-
ELSE ;
```

FIG. 9T

LANGUAGE SOURCE CODE

```
* T350 *
.T350
IF K-p- THEN
  IF R-j- THEN O-b-
    IF NOT K-s- THEN
      IF K-t- THEN S-K- O-d- J T400
      ELSE J T351
    ELSE J T370
  ELSE O-p-
.T351
  IF K-z- THEN O-t- FIN
  ELSE
ELSE ;

* T360 *
IF K-f- THEN
  IF K-z- THEN O-w- FIN
  ELSE O-f-
  IF R-j- THEN S-L- O-f-
  ELSE
ELSE ;

* T370 *
.T370
.T370A
IF K-s- THEN
  IF X4 THEN
    IF X7 THEN $-ts- FIN
    ELSE $-ds- FIN
  ELSE
  IF R-j- THEN S-L- H-60- ;
  ELSE S-N- O-s-
ELSE ;

* T380 *
IF K-t- THEN
  IF R-j- THEN
    IF K-z- THEN $-dt- FIN
    ELSE O-d- FIN
  ELSE S-R- O-t-
ELSE ;

* T390 *
IF K-j- THEN
  IF Y2=0 THEN O-,- ;
  ELSE
  IF K-z- THEN H-60- O-t- FIN
  ELSE O-j-
ELSE ;
```

FIG. 9U

LANGUAGE SOURCE CODE

```
* T400 *
.T400
IF K-z- THEN
  IF Y4=1 THEN
    IF Y3=1 THEN
      IF K-I- THEN O-z- FIN
      ELSE $-tz- FIN
    ELSE
    IF Y3=2 THEN
      IF C-R- THEN $-zt- FIN
      ELSE
    ELSE
  ELSE
  IF C-L- THEN O-t- FIN
  ELSE
  IF C-K- THEN O-s- FIN
  ELSE
  IF C-N- THEN $-ts- FIN
  ELSE O-z-
ELSE ;
FIN

END
```

FIG. 9V

REAL-TIME WORD TYPEWRITER

CROSS-REFERENCE TO RELATED APPLICATIONS

This application is a continuation-in-part of application Ser. No. 657,775, filed Oct. 4, 1984, now abandoned, the entire disclosure of which is incorporated herein by reference, which was a continuation-in-part of application Ser. No. 348,008, filed as PCT NL81/00018 on Jun. 15, 1981, published as WO81/03641 on Dec. 24, 1981, now abandoned, the entire disclosure of which is incorporated herein by reference.

FIELD OF THE INVENTION

The present invention is a word typewriter that permits typing at the speed of speech. The invention utilizes chord typing, where several keys representative of the letters of a syllable are depressed simultaneously. The simultaneously depressed keys are decoded according to certain priority rules by an electronic decoding circuit. The output of the present invention is typewritten text in standard format. In contrast, the output of a conventional shorthand machine is a paper tape containing special stenographic codes or phonetic symbols which can only be understood by a person specially trained in shorthand or phonetic codes, and which must be retyped into a standard format.

BACKGROUND OF THE INVENTION

Conventional typewriter keyboards require a typist to type individual letters one at a time, and one after another in the correct order. The present invention does away with the necessity of typing letters one by one, and one after the other.

The arrangement of the letters of the conventional QWERTY keyboard (so-named for the first six letters of the upper key row) is designed to avoid striking more than one letter key simultaneously. The typist has to move his or her hands and fingers constantly around the keyboard. Touch typing with ten fingers is rather difficult to learn. According to some sources, in a day's work a typist's fingers may travel 12 to 20 miles. Typing at the speed of human speech is virtually impossible with a conventional QWERTY keyboard.

In the past, various shorthand machines have been used to produce an output sufficiently fast to follow speech. One such machine is commonly referred to in the art as a stenotype machine. See U.S. Pat. No. 2,319,273, issued to Sterling. However, input and output to such devices could only be made by trained specialists. The output was typically produced on a paper tape that is unreadable and illegible to a layman. The paper tape contained an output which was in the form of special stenographic codes or phonetic symbols. An example of this kind of a paper tape output is shown in U.S. Pat. No. 2,449,126, issued to Kirkpatrick, and in U.S. Pat. No. 3,557,927, issued to Wright. The paper tape had to be transcribed and retyped using a conventional QWERTY keyboard typewriter to produce written text in a standard format. Transcription was oftentimes a time consuming process. A person specially trained in the stenographic codes or phonetic symbols would have to read the codes and symbols on the paper tape. The codes and symbols would then have to be retyped in standard format using a conventional typewriter. This is the method typically used, for example, by court reporters to transcribe testimony.

Thus, in the past, the production of written text in standard format based upon human speech involved a slow two step process. First, a specially trained stenographer produced a paper tape of special codes and symbols. Second, the paper tape was then retyped into written text in a standard format.

The deficiencies of the conventional QWERTY keyboard have been recognized. Other keyboard arrangements have been proposed, but have not been generally accepted.

A keyboard similar to the keyboard used with the present invention is shown in Dutch patent application No. 73.06584. But the device disclosed in Dutch patent application No. 73.06584 still produced an output in the form of a specially coded shorthand script. The script produced by such a device printed each syllable separately on a narrow roll of paper. Each syllable was printed underneath the previous one. That device did not produce written text in a standard format. The output had to be transcribed afterwards by a trained operator because a lot of special codes had to be used.

The keyboard shown in that Dutch patent application had keys for only some consonants. Other consonants were missing from the keyboard. If a typist wished to type a consonant that was missing from the keyboard, two or more keys would have to be pressed simultaneously to indicate the missing consonants. But, missing consonants would be printed in a shorthand form or code. In this case, a code was used to resemble the form of the letters on the keys. Consonants missing from the keyboard would not be printed in a standard format.

On the device shown in Dutch patent application No. 73.06584, signs or punctuation marks and digits could only be displayed by simultaneously striking a letter key and a so-called indicator key each time. The signs and punctuation marks, placed on the left group and right group of consonants, respectively, were displayed by additionally striking the left and right key, respectively of two additional thumb keys which were provided with the accentuations " " and " ". Each sign or punctuation mark is displayed by the printed combination of the letter of the key carrying the desired sign and an accentuation. A fixed indicator key, for example, the "i", had to be used for the digits 0 through 9. Digits each time were displayed in a code by the printed combination of the letter of the key carrying the desired digit and the letter "i".

When keys were pressed simultaneously in that device, the letters were printed on paper tape in the order in which the letters appeared on the keyboard, reading from left to right. The keys were not decoded or sorted according to any priority rules or decoding rules.

Thus, the output of the device shown in Dutch patent application No. 73.06584 was not in standard format, but rather was in the form of a special code. In order to obtain written text in a standard format, the output would have to be retyped by a conventional QWERTY typewriter. In this respect, it was just as unsatisfactory as old shorthand machines.

A further discussion of the prior art as contrasted with the present invention is contained in a brochure entitled "Velotype—machineschrijven op spreeksnelheid—typing at the speed of speech", by Special Systems Industry bv, Delftweg 72, 2289 BA Rijswijk, the Netherlands, the entire disclosure of which is incorporated herein by reference.

The present invention obviates these problems and provides a word typewriter which produces written text in standard format in a very fast manner. The present invention can produce a running and complete script at the speed of human speech. In sharp contrast to conventional shorthand machines, the script does not need to be retyped. Consonants which are missing from the keyboard of the present invention are displayed or printed in standard format. Also signs or digits are displayed or printed in standard format. In other words, the present invention can produce a script identical to that of a conventional QWERTY keyboard typewriter, but at the speed of speech.

SUMMARY OF THE INVENTION

The present invention is capable of providing a real-time output of typewritten text in standard format which is legible to a layman, and which does not require retyping. This is accomplished with the unique combination of the disclosed keyboard and a microprocessor implemented decoding scheme. The present invention permits a word or syllable to be typed by pressing a combination of keys simultaneously. This is called a chord, just as a pianist would press a group of keys simultaneously on a piano to play a chord. In other words, the present invention permits syllable or chord typing.

The present invention places the characters represented by the simultaneously pressed keys into the correct order so that the letters appear in a standard written format. The microprocessor implemented decoding scheme is used to arrange the characters in a correct order.

The keyboard is designed so that the hands may remain in a fixed position from which the fingers can reach all keys. This assists in producing a real-time output at the speed of speech. The arrangement of the keyboard is based on character-frequency counts. The most frequently used letters are positioned under the strongest fingers. In order to reduce the number of keys on the keyboard, the less used letters of the alphabet are missing from the keyboard, but can be formed by combining two other keys.

As explained more fully below, the keyboard contains three sets of keys grouped together in a butterfly-shaped keyboard. The keyboard contains a left-hand set of consonant keys, a right-hand set of consonant keys, and a center set of vowel keys. The two sets of consonant keys are virtually mirror images of each other. The left-hand set of consonant keys are interpreted by a microprocessor decoding scheme to be the initial consonants of the word or syllable. The right-hand set of consonant keys are interpreted by the microprocessor decoding scheme to be the final consonants of the word or syllable. The center group of vowel keys are interpreted by the microprocessor decoding scheme to go between the initial consonants and the final consonants. As keys are depressed, they are interpreted according to decoding rules, which are described in more detail hereinafter.

The keyboard enables the operator to use the left hand substantially as frequently as the right hand. In some cases, the percentages for usage have been measured to be 50.23% for the left hand and 49.77% for the right hand. By contrast, on a conventional typewriter, these percentages have been measured to be, in some cases, 61.23% for the left hand and 38.77% for the right hand. The actual percentages may vary between various languages, such as German, French, English, Dutch, Swedish, Danish, Norwegian, Portuguese, Italian and Spanish.

By dividing a syllable into a left group of initial consonants, a center group of vowels, and a right group of final consonants, the possible combinations between letters are considerably reduced. Of course, the initial consonants and the final consonants are placed before and after the vowels, respectively. Within a group of initial consonants, or a group of final consonants, the consonants are ordered according to a language dependent sorting rule, or priority rule.

The present invention should not be viewed as simply another shorthand machine; it is a typewriter that permits a typist to type so fast that it makes shorthand machines obsolete. The novel combination of the present invention makes it possible to type with a speed faster than a stenographic keyboard, with an output which does not need to be retyped, and which does not contain special codes which have to be learned in order to interpret the output. The present invention is a letter typewriter which makes syllable or chord typing possible. The present invention has been found to result in a very high typing speed after a relatively low number of training hours.

The present invention makes fast generation of standard format text at the speed of human speech possible, without the need for special codes or symbols.

BRIEF DESCRIPTION OF THE DRAWINGS

FIG. 3 depicts a more detailed block diagram of the interconnection of the decoding and processing unit with a keyboard and display.

FIG. 4 shows a slightly different but preferred keyboard arrangement.

FIG. 5 is a block diagram illustrating a flow chart for a software implementation of certain aspects of the invention.

FIG. 6 is a perspective view of a preferred embodiment of the invention.

FIGS. 8A–8S show a flowchart for a computer program to be used in accordance with the present invention.

FIGS. 9A–9V contain a source code listing of a computer program to be used in accordance with the present invention.

DETAILED DESCRIPTION OF A PREFERRED EMBODIMENT

The invention relates to a word or rapid typewriter for the display or processing of written or linguistic information.

Figure 1:
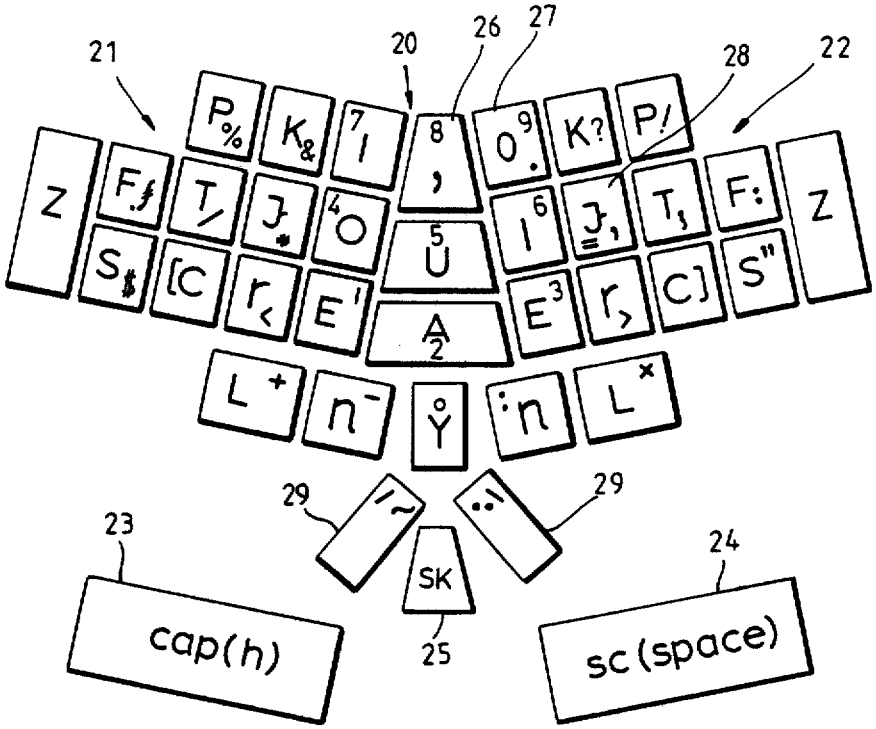
FIG. 1 shows a view of the keyboard.

The invention utilizes a keyboard 10 that preferably has 37 keys. The keys of the keyboard 10 are preferably placed in a butterfly-shaped arrangement, as shown in FIG. 1. A presently preferred keyboard arrangement is shown in FIG. 4.

Figure 2:
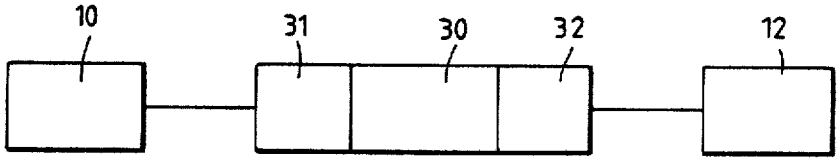
FIG. 2 is a block diagram illustrating the mutual connection of the keyboard with the decoding and processing unit, and a display, printing or memory device.

The keyboard 10 is coupled to an electronic circuit 30, as shown in FIG. 2. When keys on the keyboard 10 are depressed, the electronic circuit 30 interprets the keyboard information according to certain decoding rules and priority rules. The interpreted information is then output to a real-time display 12. The display 12 may be a printing mechanism such as a printer or typewriter carriage, or it may be a cathode ray tube or other display.

The Keyboard

Referring to FIG. 4, the keyboard 10 has a center group of keys 20 for vowels. On either side of the center group of keys 20, the keyboard 10 has in mirror positions, groups of consonants keys. A group of initial consonant keys 21 is provided on the left-hand side of the vowel keys 20. A group of final consonant keys 22 is provided on the right-hand side of the vowel keys 20.

With this word typewriter, text could be typed by sequentially striking one letter after another. But the word typewriter of the present invention is intended to be operated so that a whole word or syllable is printed by simultaneously striking several keys. Input is done with both hands. All fingers are utilized to strike keys.

In order to facilitate rapid typing, the keyboard 10 is designed so that the hands remain in a substantially fixed position from which the fingers can reach all keys. The keyboard 10 is preferably provided with thirty-seven keys. The intended placement of the hands upon the keyboard 10 is illustrated in the Velotype brochure which was previously incorporated herein by reference.

A "CAPITAL-H" bar or key 23, as shown in FIG. 4, is positioned below the ball of the left hand. Similarly, a "NO SPACE" bar or key 24 is positioned below the ball of the right hand. These bars 23 and 24 can be actuated by flexing the wrists and pressing the balls of the hands downwardly, without substantially moving the hands.

The remaining thirty-five keys are arranged based upon the frequency with which various letters of the alphabet appear in normal text. The most frequently used letters are positioned under the strongest fingers.

The vowels "A", "E", "I", "O", "U", and also "Y", are some of the most frequently used letters of the alphabet. The vowel keys 20 are positioned so that the "A", "E", "I", "O" and "U" keys can be operated by the forefingers. The forefinger is typically the strongest finger of the hand. The less used "Y" key may be operated by the thumbs.

Twenty-two keys are provided for consonants in the preferred keyboard 10 shown in FIG. 4. These twenty-two keys are grouped in one left-hand group of eleven keys 21, and in one right-hand group of eleven keys 22. Both the left-hand group of keys 21 and the right-hand group of keys 22 contain keys for the same eleven consonants. The left-hand keys 21 and the right-hand keys 22 are arranged as mirror images of each other as far as the consonants are concerned.

The eleven consonants which are preferably represented on the keyboard 10 are the letters "Z", "F", "S", "P", "T", "C", "K", "J", "R", "L" and "N". This is based upon character frequency counts.

The right-hand group of consonant keys 22 is arranged so that the "Z", "F" and "S" keys are operable by the little finger. The "P", "T" and "C" keys are operable by the ring finger. The "K", "J" and "R" keys are operable by the middle finger. The "L" and "N" keys are operable by the thumb. The left-hand group of consonant keys 21 is similarly arranged in a mirror image of the right-hand group of consonant keys 22.

There are a total of twenty consonants in the alphabet. Because only eleven of the most frequently used consonants are represented by dedicated keys on the illustrated keyboard 10, nine letters, which are consonants, are missing from the keyboard 10. The nine missing letters are the consonants "B", "D", "G", "H", "M", "Q", "V", "W" and "X". These missing letters are formed by simultaneously pressing two consonant keys.

Because this invention utilizes chord typing where all of the keys for a syllable are pressed simultaneously, it is important for the word typewriter to be able to distinguish between keys which are pressed simultaneously as part of the syllable that is being typed, and keys which are pressed simultaneously to indicate missing letters. For example, in a given chord of keys that is being typed, keys may be simultaneously pressed for both purposes. How does the word typewriter know that two keys are being pressed to indicate a single missing letter, and not for the purpose of indicating the two letters which appear on the keys?

This problem is solved in the present invention by selecting combinations of letters that do not normally appear together. This will become clearer when the decoding rules are discussed. In addition, combinations of letters are selected which will assist a typist in recalling the appropriate combination for a missing letter. For this reason, the letters on the keyboard 10 are preferably represented as shown in FIG. 4. The form of the letters that are combined, or the phonetic context, is selected as a memory aid to assist in recalling the appropriate key combination for a missing letter.

It may also be observed that the eleven consonants selected for the preferred keyboard 10 are not necessarily the eleven consonants which appear as the most frequently used consonants in a character frequency count. For example, the letter "Z", which appears on the keyboard 10, appears less frequently in the English language than does the letter "B", which is missing from the keyboard. However, it is sometimes preferable to type a missing letter, such as the letter "B", by simultaneously striking two letters with the stronger middle finger and ring finger, than to type the letter "Z", for example, by striking a single key with the weaker little finger. Nevertheless, combinations of keys to form missing letters (which are referred to sometimes as "slit positions" or "split positions") are minimized as much as possible in forming syllables.

A "SHIFT" key 25 is also shown in FIG. 4. The "SHIFT" key 25 is not used to generate capital letters. Instead, it is used to generate digits, punctuation signs or to indicate other secondary functions of the various keys.

To facilitate generation of the frequently used punctuation mark "," a "COMMA" key 26 is preferably provided above the "U" key. Because it is used less frequently than the vowel keys 20, the "COMMA" key 26 is preferably located as shown.

Two accent keys 29 are also preferably provided, and are operable by the thumbs.

The Decoding Rules

The nine missing letters from the left-hand group of consonant keys 21 are formed by simultaneously pressing the following preferred key combinations in the left-hand group of initial consonant keys 21:

B=P+J
D=T+J
G=C+J
H=J+L
M=R+N
Q=F+C
V=L+R
W=J+"CAPITAL-H" Bar

X=Z+K

Alternatively, the letter "V" may be formed by simultaneously striking the keys for the letters "F" and "J" in the left-hand group of keys 21. The letter "W" may be alternatively formed by simultaneously striking the keys for the letters "J" and "N" in the left-hand group of keys 21.

The nine missing letters from the right-hand group of final consonant keys 22 are preferably formed by simultaneously striking the following keys in the right-hand group of keys 22:

B=J+P
D=J+T
G=J+C
H=L+J
M=N+R
Q=C+F
V=J+F
W="CAPITAL-H" Bar+J
X=K+Z

Alternatively, the letter "V" may be formed by simultaneously striking the letters "L" and "R" in the right-hand group of keys 22; and the letter "W" may be formed by simultaneously striking the letters "N" and "J" in the right-hand group of keys 22.

An electronic decoding and processing unit 11, which may be included in the electronic circuit 30, is programmed or hard-wired to implement these and all other decoding rules.

In order to generate an output of written text in standard format, it is necessary for the word typewriter to sort out a group of simultaneously pressed keys to determine how the letters should appear in standard format.

This is accomplished by recognizing that most syllables can be analyzed as fitting into four categories. The four main types of syllables are:

1. syllables which contain only a vowel, for example, "o" (in, e.g.,the word "over");
2. syllables which contain an initial consonant plus a vowel, for example, "so";
3. syllables which contain a vowel plus a final consonant, for example, "at";
4. and syllables which contain an initial consonant plus a vowel plus a final consonant, for example, "sat".

In the present word typewriter, single syllables and monosyllabic words may be printed by one stroke. In a single stroke, a typist may depress several keys simultaneously. Recognizing that most syllables can be broken into one of the above four groups, the keys on the keyboard 10 are arranged to take advantage of this principle. That is why two identical groups of keys 21 and 22 representing consonants are available on the keyboard 10. The left-hand group of consonant keys 21 is used to represent initial consonants of a syllable. The right-hand group of consonant keys 22 is used to represent final consonants of a syllable. A group of keys 20 representing the vowels lies in the center of the keyboard 10 between both groups of consonant keys 21 and 22.

Of course, every syllable has a vowel. The decoding rules provide that letters generated by striking keys in the left-hand group of keys 21 are placed before the vowel. Letters generated by striking keys in the right-hand group of keys 22 are placed after the vowel.

These decoding rules are sufficient to generate text in standard format for many common syllables. But some syllables do not fit into the simple rules. Two or more initial consonants may appear at the beginning of a word. For example, some syllables may contain more than one vowel. Some syllables may contain two or more final consonants. The one syllable word "should" illustrates this. The syllable "should" contains two vowels "ou", the two initial consonants "sh", and the two final consonants "ld".

To type the syllable "should", a typist could simultaneously depress the following chord of keys: the keys "S", "J", and "L" in the left-hand group of keys 21, the vowel key "O" near the left index finger and the vowel key "U" from the center group of keys 20, and the "L", "J" and "T" keys from the right-hand group of keys 22. The decoding rules are implemented in recognition of the fact that the letters "S", "J" and "L" do not normally appear together as initial consonants at the beginning of a syllable. The simultaneously pressed keys are sorted according to certain priority rules to determine (1) which combinations of keys are intended to represent missing letters, and (2) what order the letters are to be printed or displayed.

The priority rules will vary from one language to another, and are thus language dependent. The priority rules for the English, Dutch and German languages are represented in the flow charts attached hereto as Listing 1, the entirety of which is incorporated herein by reference.

In the example of the syllable "should", the decoding rules are used to determine that the simultaneously pressed letters "J" and "L" in the left-hand group of keys 21 are intended to represent the missing letter "H". The priority rules are used to determine that the letter "S" should go before the letter "H".

For the vowels "O" and "U", the "O" is placed first, either because it was indicated with the left-hand vowel key for the "O" (instead of the right-hand "O" key), or because the priority rules determine that for this particular language the vowel "O" normally precedes the vowel "U" when they appear together in the same syllable. The latter priority rule applies in an English language implementation.

Similarly, the left-hand keys 22 are decoded to determine that the keys "J" and "T" are intended to represent the missing letter "D". The priority rules determine that the "L" should appear before the "D" as final consonants.

Therefore, the word "should" is output in standard format, and can be immediately printed or displayed. Alternatively, the information may be stored in memory for further processing.

The groups of letters which form a syllable may be extended by adding even more vowels or consonants, for example: "eau" in the word "beautiful"; "rts" in the word "arts"; and "str" in the word "street"; etc.

In a minimal number of exceptional circumstances, the last letter of a combination, or first letter, may have to be struck separately. For example, the word "film" would normally require a typist to depress the "L" key with the right thumb. The "R" key and "N" key would both be depressed simultaneously to indicate the missing letter "M". If it is awkward to strike the "L" and "N" keys simultaneously with the thumb, the last letter "M" may be formed separately.

Certain priority rules are utilized to determine the sequence in which simultaneously pressed initial consonant keys representing two or more initial consonants are to be displayed. This is not to be confused with instances where two keys are pressed to represent a single letter missing from the keyboard, so that only one initial consonant is to be displayed. Similarly, certain priority rules are utilized to determine the proper sequence for displaying final consonants.

For example, in English, the initial consonants of the syllable are ordered according to the following priority scheme or rule: "X, Z, S, B, P, G, QU, Q, C, D, T, V, W, F, J, H, K, L, M, R, N". The final consonants are sorted according to the following priority rules: "V, L, M, R, W, N, G, K, C, X, B, P, H, D, S, E, F, T, Y, Z", where the E is meant as a final mute "E" at the end of word, such as the word "move", and no word ends with the consonants "J" or "Q". In practice, it has been observed that 90–95% of the syllables may be resolved correctly by the priority rules. The remainder may be resolved by context. For example, in a software implementation of the present invention, exceptions to the general priority rules can be programed into the system, and in appropriate circumstances the apparatus can check for such an exception when the context is such that an exception is possible.

The priority rules are implemented in the flow chart of Listing 1, shown in FIG. 8A through FIG. 8K which is incorporated herein by reference. The Dutch, and German languages are shown implemented. An example for the English language word "should" was discussed above.

In a Dutch implementation of the present invention, for example, the simultaneous depressing of the "K" and "O" keys with the left hand and the "T" and "R" keys with the right hand is interpreted as the word "kort", which in Dutch means "short". As another example, the simultaneous depression of the "T", "S" and "O" keys with the left hand and the "L" and "E" keys with the right hand is interpreted as the word "stoel", which in Dutch means "chair".

Each time a period appears in text, the decoding rules automatically assume that a sentence has ended. In that case, the decoding rules automatically insert a space following a period, and the first letter of the syllable formed by the next chord of keys is automatically capitalized. Because this is a correct assumption in the majority of instances where a period is encountered in normal text, this automatic rule reduces the amount of manipulation required by a typist, and consequently contributes to the achievement of high speed typing. This automatic function can be overridden when necessary.

The operation of the "NO SPACE" bar 24 that is implemented according to the decoding rules is different from the space bar of a conventional typewriter.

Most words in normal text are one syllable. The present invention assumes that every chord of keys is a single syllable word. Thus, a space is automatically inserted after a chord of keys forms a syllable of text. This automatic function may be overridden by depressing the "NO SPACE" bar or key 24.

This has been found to reduce the amount of manipulation required for the keyboard because monosyllabic words occur more frequently than polysyllabic words in the standard written format of text. When the "NO SPACE" bar 24 is depressed, two succeeding syllables are linked into a single word. However, if individual letters are depressed without simultaneously depressing any other keys, a space is not inserted unless the "NO SPACE" bar 24 is depressed. Thus, the microprocessor implemented decoding rules automatically inset a space where it is most frequently needed, and automatically omits a space where it is most frequently not needed, and the "NO SPACE" bar 24 in the present invention is used to override the automatic operation of the microprocessor.

The operation of the "CAPITAL-H" bar or key 23 is implemented by the decoding rules as follows.

When the "CAPITAL-H" bar 23 is actuated simultaneously with other consonant keys, the "CAPITAL-H" bar 23 is interpreted as the letter "H". The first letter of a syllable is interpreted as a capital letter when the "CAPITAL-H" bar 23 is actuated alone, prior to pressing another chord of keys.

As explained above, a space is automatically inserted following a period, and the next letter is capitalized. This automatic function may be overridden if the "CAPITAL-H" bar 23 and "NO SPACE" bar are simultaneously actuated prior to the next syllable. In this case, the "CAPITAL-H" bar 23 actually performs an inverse function to override an automatic capitalization. The "CAPITAL-H" bar 23 may be used alone to perform the inverse function of overriding an automatic capitalization of the following letter, after a period. In such an event, the space will be automatically inserted but the following letter will not be capitalized.

The "CAPITAL-H" bar 23 may be simultaneously actuated with the "N" key and the "J" key on the left side of the keyboard to form the beginning consonant combination "WR". Ordinarily, the letter "W" would be formed by pressing the letters "F" and "J" simultaneously with the left hand. However, to form the combination of "WR", the typist would have to press both the "J" key and the "R" key with the middle finger of the left hand. Instead, the combination of the "N" key, the "J" key and the "CAPITAL-H" bar 23 is used to indicate this beginning consonant combination. This eliminates the need for a typist to press two keys with the middle finger of the left hand, which is a weaker finger. This novel arrangement contributes to the speed of the present word typewriter.

Certain awkward key combinations are avoided by the decoding rules. For example, the initial consonants "P" and "R" sometimes appear together at the beginning of a syllable, such as in the word "prune". To simultaneously depress these two keys, the fingers of the left hand must perform an awkward keystroke combination, using the ring finger and the middle finger. It would be less awkward to strike the "P" key and the "K" key simultaneously. Because the initial consonants "P" and "K" do not ordinarily appear together in a syllable as initial consonants, when the "P" and "K" keys are simultaneously depressed, it is interpreted as the letters "PR". The following such combinations of simultaneously pressed keys in the left-hand group of keys 21 for initial consonants are recognized by the microprocessor implemented decoding rules:

"PK" interpreted as "PR"
"SPK" interpreted as "SPR"
"TK" interpreted as "TR"
"STK" interpreted as "STR"
"FK" interpreted as "FR"
"FJN" interpreted as "VR"
"TJN" interpreted as "DR"
"CJN" interpreted as "CR"
"PJN" interpreted as "BR"

The following similar combinations of simultaneously pressed keys in the right-hand group of keys 22 representing final consonants are recognized by the microprocessor implemented decoding rules:

"TZ" interpreted as "TS"
"PZ" interpreted as "PT"

"KT" interpreted as "CT"
"KTS" interpreted as "CTS"
"CZ" interpreted as "CH"
"GL" interpreted as "GH"
"GLZ" interpreted as "GHT"

These key combinations are recognized in order to minimize the strain upon an operator's hand and to make keystrokes easier, and to minimize occasions when two keys must be actuated by either the operator's little finger, ring finger, or middle finger.

The letter "A" frequently appears alone as a word. It is desirable to reduce manipulation of the "NO SPACE" bar 24, which must be used to generate a space when a single letter is typed in order to override the automatic linking implemented by the decoding rules. When the letters "O" and "I" are depressed simultaneously, with no other keys, it is interpreted as the word "A", which is automatically spaced accordingly.

Certain other combinations of keys which do not ordinarily appear in text may be chosen for certain functions. The combination of simultaneously depressed "C" and "R" keys from the left-hand group of keys 21, and "R" and "C" keys from the right-hand group of keys 22, is preferably used to erase the last-entered chord of keys. In other words, the simultaneous pressing of these four letters alone is recognized by the decoding rules as a request for a correction function. These letters are chosen because they are easy to depress simultaneously due to their location on the keyboard, the combination of letters "CR-RC" tend to phonetically suggest the idea of "correct", and this combination of letters with no vowels does not appear in normal text.

A carriage return may be generated by simultaneously pressing the "Z" key in the left-hand group of keys 21 and the "Z" key in the right-hand group of keys 22. This letter combination, which does not appear in normal speech, is recognized as a carriage return.

Further details are disclosed in the booklet entitled "Velotype—Machineschrijven Op Spreeksnelheid—Handleiding Voor Het Gebruik", by Special Systems Industry bv, Delftweg 72, 2289 BA Rijswijk (2h), Netherland, dated 83.11 (November 1983), the entire disclosure of which is incorporated herein by reference.

The vowel keys 20 are mainly operated by the forefingers, and sometimes by the thumbs. Syllables or words are formed as far as possible by striking as few slit positions, i.e., stroke positions in which fingers are simultaneously placed on two keys, as possible. A phonetic or form context is provided between the letters missing from the keyboard and those which take their place and which are formed by a slit position. The context is made as logical as possible. The letters on the keys sometimes have a graphic form deviating somewhat from the standard type, or use is made of small and of capital letters, to obtain symbolic forms of the letters on the keys which suggest the letter that is formed by pressing two keys simultaneously. For example, if the letter "F" is inclined backwards, then the combination "FJ" tends to suggest the letter "V".

The present invention provides a "SHIFT" key 25 for the selection between letters and either punctuation signs or digits. The "SHIFT" key 25 is used to indicate the punctuation mark or digit that appears in the upper right-hand corner of the keys illustrated in FIG. 4. The "SHIFT" key 25 is not used to generate capital letters. The frequently used comma and period punctuation marks are treated specially in order to increase typing speed by reducing the required manipulation of the keyboard. When the "O" key 27 to the right of the "COMMA" key 26 is depressed alone, it is interpreted as a period. When the "J" key 28 in the right-hand group of keys 22 is depressed alone, it is interpreted as a comma.

As explained in more detail below, all keys are coupled to an electronic decoding and processing unit 30. The electronic decoding and processing unit 30 decodes the signals from the keys and subsequently supplies signals representing standard letters, signs or digits. Combinations of simultaneously struck letter keys are processed into the standard display of the appropriate letters.

With the aid of a word typewriter according the present invention, "slit positions" between keys can be avoided as much as possible. This is desirable, because if slit position strokes must be actuated by fingers other than the forefinger, such actuation will result in some tension in the fingers that must be used to actuate the slit positions. These kind of finger movements are more difficult, and will slow down the typist. By avoiding the necessity for key strokes which are difficult, the present invention makes it easier for a typist to learn to type rapidly using the invention. Also, less workable syllable combinations which contain a "R" are preferably represented in another manner. The number of required keys is limited by combining phonetic and/or form related letters in order to generate the consonants missing from the keyboard both on the keys to the left and the right side of the center group of vowels. All of these features combine to permit typing at the speed of human speech which results in an output that is in a standard text format.

The Electronic Decoding and Processing Unit

Referring to FIG. 2, all keys of the keyboard 10 are coupled to an electronic decoding and processing unit 30. The electronic decoding and processing unit 30 decodes signals from the keyboard 10, and outputs signals to an output device 12. The output signals direct a printer to print letters in a standard format, or a display to display such letters, etc.

The electronic decoding and processing unit 30 may be implemented as a diode matrix decoder. The diode matrix is wired up to implement the decoding rules. Those skilled in the art will appreciate how the keyboard 10 may be hard-wired to implement the herein described decoding rules. The various decoding rules are spelled out throughout this specification.

This word typewriter is preferably implemented using a microprocessor controlled electronic decoding and processing unit 30. In the case of a microprocessor implementation of the invention, the processing unit 30 may be interfaced to the keyboard 10 through an input circuit 31. The processing unit 30 may be interfaced to the output device 12 through an output circuit 32.

The microprocessor implemented decoding and processing unit 11 is illustrated in more detail in FIG. 3.

The keyboard 10 is preferably wired so that the key switches are arranged in an electrical matrix. An eight by eight matrix is preferred, and results in 64 available switch matrix positions. The keyboard 10 may be scanned for depressed keys using a technique sometimes referred to as matrix-multiplexing. An example of matrix-multiplexing is shown in U.S. Pat. No. Re. 31,441, issued to Nutting et al. The Nutting et al patent discloses a microprocessor controlled structure where a microprocessor multiplexes input switches and responds to the input switches under program control and by displaying an output on a multiplexed display. The Nutting et al patent is incorporated herein by reference.

One important multiplexing consideration is that some keys are not depressed simultaneously with each other. For example, the ring finger operates the "P", "T" and "C" keys, which are arranged in a single column. The ring finger can only depress one key at a time. These keys are placed in the same column because they do not normally appear together. Therefore, multiple closures in the same column need not be detected.

The microcomputer 11 is connected to the keyboard 10, reads out the actuated keys in regular timing intervals, and converts this to signal information representative of a string of characters. A cyclic buffer 13 is used for temporary storage of signals from the keyboard 10 until a microprocessor 14 is able to process them. The microprocessor 14 processes the signals under program control in accordance with the decoding rules and priority rules into signal information representative of a string of characters that represents written text in standard format. This character information may then be stored in a further memory 15 in the microcomputer 11 for subsequent use. For example, the contents of the further memory 15 may be output via a data communications interface 16 for printing, for processing by a word processor, or for storage in a magnetic disc or on a magnetic tape. Alternatively, the contents of the further memory 15 may be displayed on a display device 12, such as a CRT display 12. If desired, cursor control keys 18 may be provided.

The microcomputer takes signals from the cyclic buffer 13 and converts them under program control into a string of characters in accordance with the decoding rules and priority rules, which are described throughout this specification.

A suitable program is stored in a ROM 17 to implement the decoding rules. Suitable programs for the Dutch, English and German languages are contained in the programs disclosed in Listing 2, shown in FIG. 9A through FIG. 9K, which is incorporated herein by reference in its entirety.

Figure 7:
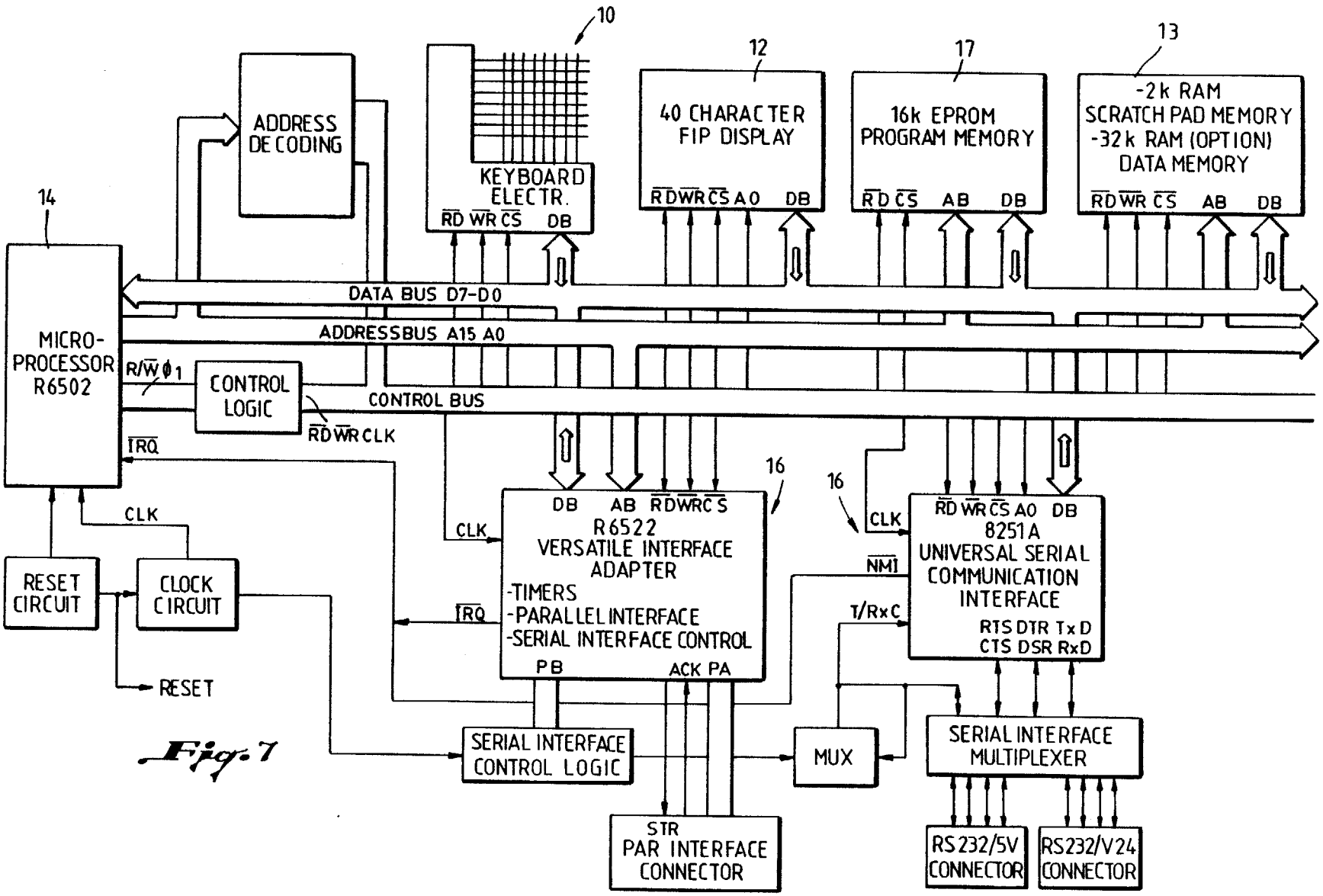
FIG. 7 is a schematic diagram of the circuit illustrated in FIG. 3.

The circuit illustrated in FIG. 3 is shown in more detail in FIG. 7.

A commercially available keyboard input circuit board 31 may be used with satisfactory results. A suitable circuit board is manufactured by Philips Germany, Eiserfelderstrasse 316, Eiserfeld-Siegen, West Germany. The circuit drawings for that keyboard circuit board, and specifically the drawing part no. FVL, dated Mar. 17, 1983, and the construction drawings parts no. 830060000 No. 1 entitled "SSI Keyboard", No. 2 entitled "Caten Patroon" (hole pattern), No. 3, No. 5 entitled "M3 Toets" (M3 key), No. 6 entitled "M ¼ Toets" (M ¼ key), No. 7 entitled "M 2/5 Toets" (M 2/5 key), No. 8 entitled "Muistoets" (ball key), and No. 10, are incorporated herein by reference. The actual wiring of the keyboard may be better understood by reference to the two part 5112 221 97931, dated Dec. 5, 1985, which are incorporated herein by reference.

Similarly, a commercially available display circuit board may be used with satisfactory results. A suitable display circuit board 32 is manufactured by NEC, which is represented in Holland by Malchus, Fokkerstraat 11, Schiedam, the Netherlands. The circuit drawings for that display circuit board, part no. FM40X1AA-A, is incorporated herein by reference. More specifically, the NEC Preliminary Specification entitled "Fluorescent Indicator Module FM40X1AA-A," published by Nippon Electric Co., Ltd., now known as NEC Corporation dated July 15, 1982, is incorporated herein by reference. In addition, the NEC publication entitled "Dot Type Fluorescent Indicator Module Selector Guide," published by NEC Corporation, is also incorporated herein by reference.

The remainder of the circuits for the electronic decoding and processing unit 30 may be placed upon a basic electronic circuit board wired in accordance with the circuit diagram, part no. 83015-00001, of Special Systems Industry bv, Delftweg 72, 2289 BA Rijswijk, the Netherlands. The entire disclosure of that circuit diagram, consisting of a two-part drawing no. 83015-00001, dated May 20, 1983, is incorporated herein by reference. The component layout for that circuit diagram is shown in drawing no. 83015-00000, dated May 20, 1983, which is also incorporated herein by reference. The integrated circuits (IC's) shown in drawing no. 83015-00000 are identified in Table I.

TABLE I

| | | |
|---|---|---|
| IC 1 | LM 555CN | National Semiconductors |
| IC 2 | 74 LS02 | National Semiconductors |
| IC 3 | 74 LS00 | National Semiconductors |
| IC 4 | R 6502 | Rockwell (microprocesor) |
| IC 5 | 74 LS00 | National Semiconductors |
| IC 6 | 74 LS126 | National Semiconductors |
| IC 7 | 74 LS138 | Texas Instruments |
| IC 8 | 74 LS138 | Texas Instruments |
| IC 9 | 74 LS00 | National Semiconductors |
| IC 10 | 74 LS02 | National Semiconductors |
| IC 11 | R 6522 | Rockwell (timer-input/output) |
| IC 12 | 8251 A | Mitsubishi (USART-serial interphase) |
| IC 13 | 74 LS161A | National Semiconductors |
| IC 14A | 74 LS04 | National Semiconductors |
| IC 14B | 74 LS04 | National Semiconductors |
| IC 15 | DS 1488 | National Semiconductors |
| IC 16 | DS 1489 | National Semiconductors |
| IC 17 | 74 LS373 | National Semiconductors |
| IC 18 | 74 06N | National Semiconductors |
| IC 19 | 74 LS 393 | Texas Instruments |
| IC 20 | 2732 | Mitsubishi (EPROM) |
| IC 21 | 2732 | Mitsubishi (EPROM) |
| IC 22 | UPD 4016 | NEC |
| IC 23 | 2732 | Mitsubishi (EPROM) |
| IC 24 | UPD 4016 | NEC |
| IC 25 | 2732 | Mitsubishi (EPROM) |
| IC 26 | 74 LS02 | National Semiconductors |
| IC 27 | 74 LS38 | Texas Instruments |
| IC 28 | 40373BP | Signetics |
| IC 29 | 40373BP | Signetics |
| IC 30 | LM 311 | National Semiconductors |
| IC 31 | not present | |
| IC 32 | TC 5565PL | Toshiba (RAM) |
| IC 33 | TC 5565PL | Toshiba (RAM) |
| IC 34 | TC 5565PL | Toshiba (RAM) |
| IC 35 | TC 5565PL | Toshiba (RAM) |
| IC 36 | 74 LS138 | Texas Instruments |

In a preferred embodiment, the hardware is distributed over three printed circuit boards: a basic electronic PCB, a keyboard PCB, and a display PCB. The basic electronic PCB comprises a microprocessor 14, program memory 17 and text memory 13, and also the electronics for controlling the keyboard 10, the display 12, and the output signals to peripheral devices 16. The output 16 may be controlled with the aid of a USART, which provides a RS 232C serial output. A parallel interface may also be included if desired. External buffering may be necessary with a parallel interface. In a preferred embodiment, a Rockwell R6522 versatile interface adapter may be used. For serial output, an 8251A universal serial communication interface gives satisfactory results.

In a preferred embodiment, the keyboard 10 may include 37 letter keys and 15 function keys which are wired in a matrix provided with diodes. The display 12 preferably is a 40 character fluorescent indicator display which is directly connected to the data bus connector.

A suitable microprocessor is manufactured by Rockwell International Corp., which is sometimes referred to as the R6502 microprocessor. It has a clock frequency of 1 MHz. In order to realize communication with the various other integrated circuit chips, a separate RD and WR signal may be derived from the available RD/WR signal in a manner which should be apparent to those skilled in the art. This is illustrated in FIG. 7. The address lines A0 and A1 on the address bus are preferably buffered via an external buffer in relation with the loading by the peripheral equipment, as will be apparent to those skilled in the art.

The clock frequency is preferably realized on the basis of a 4 MHz crystal, the frequency of which is divided by four to produce the 1 MHz clock frequency. A separate clock circuit output is preferably provided to the serial output 16, implemented with a USART device. In a preferred embodiment, the clock frequency is further divided by 52 in order to obtain a suitable frequency for the adjustment of the baud rate for the serial output 16. This is preferably accomplished in a serial interface control logic circuit, as shown in FIG. 7. The desired frequencies for the commercially standardized baud rates of 300, 600, 1200 and 2400 baud can be derived from the clock frequency with the aid of a suitable divider, as will be apparent to those skilled in the art. The divider is preferably a software adjustable divider. In a preferred embodiment of the invention, the frequency deviation is preferably limited to 0.15%.

The speed of the microprocessor is such that operations may be performed tens to hundreds of times per second. The cyclic buffer 13 also stores keyboard input when the processor is performing a task, such as printing, which may take a sufficiently long time to complete that several groups of keys could be actuated prior to completion of the task.

Because the microprocessor 14 operates so fast, it may attempt to read the keyboard 10 several times during the few moments that a typist attempts to simultaneously depress several keys. At such high speeds, some keys may make contact an instant prior to others. A fast microprocessor 14 could try to process an incomplete set of keys as a chord if it immediately recognized each key the instant the key was depressed. Chord typing is preferably implemented by using a memory device called an LGA memory.

The LGA memory stores a signal representative of each key that is depressed on the keyboard 10 until a "new syllable" signal is generated. A "new syllable" signal is generated when all keys are released. At the moment that all keys are released, the "new syllable" signal causes the contents of the LGA memory to be transferred to the cyclic buffer 13. In this manner, chords of keys are appropriately recognized.

The microprocessor 14 regularly checks the cyclic buffer 13 to determine whether it contains any information. If the cyclic buffer 13 is not empty, then the oldest contents of the cyclic buffer 13 representing a single chord are processed according to the program stored in the ROM 17. In other words, the contents of the cyclic buffer 13 are processed on a "first in-first out" basis.

The flow chart of FIG. 5 describes the operation of the invention. Signals are read from the keyboard into a cyclic buffer 13. The signals are then taken from the cyclic buffer 13 by a microcomputer 11 which creates a string of characters in accordance with the various decoding rules and priority rules. The processor is then used to generate an output, and to go back and get the next set of signals from the cyclic buffer 13.

The keyboard scan 40 is preferably implemented by scanning a matrix of keys. Matrix multiplexing may be used.

The language interpretation step 41 is an important step for purposes of the present invention. In this step, certain priority rules and other decoding rules are implemented.

The function key handler step 42 is used to signal a branching from normal text processing. For example, the "SHIFT" key 25 indicates that the keys are to be interpreted as a digit or punctuation mark, etc., as shown on the keyboard 10. Or the capability of the microprocessor to perform calculations may be invoked.

Information is stored in the cyclic buffer 13 until it can be processed. If the information is text, it is processed in step 43. If a special function is invoked, it is processed in step 44. If direct out is desired, this may be done in step 45.

In some cases, it may be desirable to switch from one language to another, or to perform other operations. This may be done by convenient key combinations which do not occur in normal text, or by special dedicated keys. This operation is illustrated by step 46.

The processed information is stored in the output buffer 15, and may be output to memory, to a printer, to a CRT, or to another device such as a word processor, if desired.

A Preferred Housing For The Invention

FIG. 6 illustrates a preferred housing 50 for the invention. Such a housing 50 is also depicted in the Velotype brochure and Velotype booklet, both of which were previously incorporated herein by reference.

The housing 50 is preferably portable for convenience of use. A one-line matrix display 51 is preferably provided to permit a typist to see a running copy of the text during typing. A forty character display 51 has given satisfactory results in practice. If a mistake is made, it can be corrected (for example, by pressing the keys "C", "R", "R" and "C").

A printer mechanism 52 is preferably included, to make the embodiment a complete portable typewriter. If desired, the printer 52 may delay until text passes off of the display 51 before printing. This way, corrections can be made prior to printing. Alternatively, corrections may be made as with conventional typewriters.

A CRT display may also be used, as illustrated in the Velotype brochure incorporated by reference herein. This provides a user-machine interface much like a word processor. Alternatively, the present invention may be utilized to provide rapid input into a conventional word processor.

The Keyboard of FIG. 1

The keyboard disclosed in FIG. 1 resembles the keyboard indicated in Dutch patent application Ser. No.

73.06584 with the exception, however, of some significant differences.

On the central vowel group 20 of ten keys in the middle, the letter "I" (two times), "0" (two times), "E" (two times), "U" (once), "A" (once) and "Y" (once) are displayed while also the mark "," (comma) is indicated.

At the left-hand and the right-hand side in image position a limited number of consonants are indicated, namely the consonants "Z", "F", "S", "P", "T", "C", "K", "J", "r". These keys are positioned such that the keys "Z", "F", "S" in principle can be operated by the little finger, the keys "P", "T", "C" can be operated by the ring finger, the keys "K", "J", "r" can be operated by the middle finger, and the vowel keys 20 in principle can be operated by the two forefingers.

Another row consisting of five thumb keys, is taken up below the above mentioned group of letter keys, the middle key of which other row is destined for the vowel "Y", an the two left keys of which are destined for the letters "L" and "n" and the two right keys of which are destined for the letters "n" and "L".

Furthermore, signs or digits are indicated on all above mentioned keys, which signs or digits are printed or processed with the aid of an additional thumb key, the so-called shift key 25 (indicated by "SK" in FIG. 1) under the row of said five thumb keys, for shifting from letters to signs (marks) or digits and vice versa. Another sign key is positioned at the left and at the right side respectively of this shift key which other sign keys 29, respectively carry the accentuations " " and " ".

Near the lower edge of the keyboard 10 another pair of keys or preferably bars destined for the ball of the hands is positioned, namely at the left side the uppercase letter or lowercase letter and h-bar 23, which is the so-called capital (h)-bar or case shift bar 23 (indicated by cap(h) in FIG. 1), and at the right side the linking-up and space bar 24, the so-called syllable connector-bar 24 (indicated by SC (space) in FIG. 1). In this case the decoding and processing unit decodes the signals from the left-hand ball bar 23 destined for the display of capital letters or the ordinary letter "h" respectively such that when this ball bar 23 is pre-actuated separately the following syllable starts with a capital, and when said bar 23 is actuated simultaneously with one or a plurality of other letter keys, representing initial consonants, it is displayed as the letter "h".

Unlike the usual typewriter, the word typewriter according to the invention is also embodied so that in connection with the decoding and processing unit a space occurs automatically after striking a syllable. As it is proved that monosyllabic words occur much more frequently than polysyllabic words in normal text, this method gives a considerable reduction in manipulation. When one wants to link-up or connect the syllables as required in a polysyllabic word, for example in "to harden", accordingly after "har" the syllable "den" has to be struck simultaneously with the right-hand ball bar 24 (linking-up or anti-space bar in this case), by which actuation the two syllables are displayed in connected condition. It is also possible to sequentially strike letter after letter in which case the said right ball bar 24 functions as a space bar. By this, one is capable with the aid of the decoding and processing unit to combine the two possibilities, and such that in the few cases in which it is required to separately strike the last letter of a syllable, e.g. in "fil-m" and "war-m", the right ball bar 24 does not have to be actuated.

If at the end of a sentence a period is actuated, automatically a space is introduced via the decoding and processing unit, and also the first letter of the following syllable is displayed as a capital. In case a capital and a space is not required after a period, such as in "e.g.", one uses the left and right-hand ball bars 23 and 24 after "g." in order to avoid the printing of a capital and the generation of a space.

Therefore, both ball bars 23 and 24 have important functions, namely the left bar 23 for displaying a capital (and second an additional "h") and the right bar 24 for linking up syllables (and secondly for generating a space). When these bars 23 and 24 are used beyond their main standard function, they have an inverse action. Namely in case of a period and preceding a single letter, the left bar 23 is used to avoid the display of said letter as a capital, and in case of sequential letter after letter display the right bar 24 is used to separately display the space each time.

The major punctuation marks (period and comma) are simply obtained by the separate actuation of the "0" for the right hand (period) and the right "j" (comma) without the need in this case for actuating the shift key 25 (SK).

Also the possibility is provided as mentioned earlier for displaying the following consonants at the beginning of a syllable: "Z, S, F, P, T, C, K, J, r, L, n". These are eleven consonants. The missing nine consonants (the whole alphabet comprises 26−6 =20 consonants) are obtained by a combination of letters as follows:

B =P+J
D=T+J
G=C+J
H=J+L
M=r+n
Q=C+F
V=L+r
W=J+n
X=Z+K

If required other combinations of certain letters are possible, such as V=F+J and W=J+cap(H) bar.

Furthermore the following final consonants can be displayed with the aid of the keyboard: "n, L, K, J, r, P, T, C, F, S, Z". These are eleven consonants.

The missing nine consonants again are obtained by mutual combinations, namely:

B=P+J
D=T+J
G=C+J
H=J+L
M=r+n
q=C+F
V=F+J
W=J+n
X=K+S

Also, in this case other combinations if required are possible, such as V=L+r and W=J+cap(H) bar.

This system of combinations is based on the phonetic and/or form context between the struck letters and the missing consonants. By an adapted graphic composition of the letters on the keys, as indicated in FIG. 1, one can utilize this form context. For example the letter "F" may be indicated somewhat inclining backwards, by which the combination "FJ" optically approaches the letter form "V".

An example of the avoidance of slit positions in this invention for less suited fingers is the beginning syllable "DR", "GR", "VR" or "WR". In order to strike this group one could place the middle finger on the slit between the "J" and the "R". However, one can avoid this by striking the thumb key "n", which by its form already recalls the "r". In the said combinations this letter is represented or printed as an "R" due to the decoding and processing unit. Beginning consonant combinations "DN", "GN", "BN", "VN", and "WN" namely do not occur in the modern western languages. The letter "W" from the above mentioned initial combination "WR" is obtained in connection with the decoding and processing unit by simultaneously striking the "J" and the capital bar 23 (cap (h)).

An example of the avoidance of tension in the fingers is the beginning consonant combination "(S)PR", "(S)TR" or "FR", which upon using the centrally placed "r" would not be so easy to operate. As an alternative to using "R" in this combination, one can use the "K" beside the "P" on the upper row, which "K" is shown in a somewhat special form, by which in the said combinations it recalls the "R" and which is displayed as an "R" due to the decoding and processing unit.

Further examples of the avoidance of tension or strain during the operation of the keys are the following combinations (in which - means: part of the syllable), which are correctly displayed as standard letters with the aid of the decoding and processing unit:

| to be actuated | display |
|---|---|
| TZ | TS |
| PZ | PT |
| KT(S) | CT(S) |
| OI | A (in basicposition) |
| CZ | CH |
| GL | GH |
| GLZ | GHT |

In FIG. 2 a simple block diagram is indicated of the manner in which the decoding and processing unit in the keyboard device and a further processing unit, such as a display-, printing- or memory unit, are connected to each other.

The keyboard 10 is connected via a conventional input circuit 31 to an electronic decoding and processing unit 30. The decoding and processing unit 30 reads the state of each of the keys with the aid of said input circuit 31, i.e., in order to determine whether a key is struck or not. On the basis of certain decoding rules programmed into the decoding and processing unit 30, or provided by a diode matrix, certain letters, signs or digits finally are supplied via a conventional output circuit 32 to the display, printing or memory device 12.

The decoding and processing unit 30 may utilize a microcomputer. The electronic unit 30 is connected to the keyboard and the further processing unit 12 via input/output circuits 31 and 32, respectively. At regular timing intervals the keyboard 10 is read out by the electronic unit 30, during which information about the state of the keboard 10 is received, which information is converted into a string of characters.

Each time it is established that, after the actuation of one or a plurality of keys, no further key is actuated anymore, this is signaled. This happens therefore at the point of time that all keys are released. This is called the signal "new-syllable". In a memory field LGA (=syllable display) it is indicated which keys are actuated since the last signal "new-syllable". Upon each signal "new-syllable" the contents of the memory field LGA are put in a cyclic buffer TBBuf (=keyboard buffer) which cyclic buffer may hold a plurality of these contents.

Regularly it is investigated whether there are LGA-contents yet in this cyclic buffer TBBuf. If the buffer TBBuf is not empty, the oldest LGA-contents present in the buffer is removed from this buffer and is decoded. That means that one or a plurality of letters, signs or digits are generated in accordance with the applicable rules therefore. The unit decodes the signals of the simultaneously struck keys into corresponding letters, including the letters missing from the keyboard which are formed by the simultaneous actuation of two keys, and thereafter the unit places the thus obtained and unordered set of letters in the correct order in accordance with the applicable sequence rule. These characters are stored in a further memory in the decoding and processing unit and may subsequently be used for several purposes. For example they may be supplied via a data communication interface to a word processor, a further memory, such as a tape or magnetic disk, for later editing and/or printing, for displaying on a visual display device or as sub-title in a television image. The present device together with a trained operator is fast enough so as to make simultaneous translations.

The letters, signs or digits displayed for example on a display device, may be erased with the aid of special keyboard functions, the operation of "CR RC" (=to correct) keys. This gives a correction possibility for the characters displayed on the display device.

When the cyclic buffer TBBuf is empty, the decoded contents of the memory field LGA are displayed in the first positions of the display device. This gives the operator of the keyboard a direct feedback to his strokes. This action with an empty TBBuf, is not essential for the operation of the typewriter according to the invention.

The above indicated series of operations is normally repeated tens to hundreds of times per second. The use of a cyclic buffer gives also the possibility to conclude from time to time operations which are somewhat longer, e.g. the printing of a line on a display device which is of a duration of about 0.5 seconds, without losing, or the erasure of, any syllables inputted during this period. For these syllables are put automatically in the cyclic buffer.

The timing intervals, during which the keyboard is read out, are selected so that they are small in relation to the speed the operator operates the keyboard (during each stroke the keyboard is at least read out a few times), but they are large in relation to the time that contact vibration may occur after striking or releasing of a key (characteristic for most keys are times between two and fifteen msec.). In the present prototypes an interval time of 50 msec. is selected.

Apart from the generation of a series of letters, signs (or marks) or digits, the decoding and processing unit may provide for special operations with the aid of key combinations specially assigned for this purpose, such as switching to a new line, switching to a different language (decoding rules) e.g., by which the keyboard is operated, etc.

As mentioned above digits in standard form may also be displayed via the keyboard. Advantageously these digits are indicated on the keys of the centrally placed vowel group such that the digit "0" is positioned on the middle thumb letter key and the digits "1, 2, 3" and "4, 5, 6" and "7, 8, 9" successively are positioned on the three rows of three vowel keys. In this manner this block of digits has a form resembling a usual pocket calculator.

The word typewriter may advantageously be embodied such that the left two and the right two thumb letter keys respectively are provided with the signs "+", "−", ":", "×", and that the decoding and processing unit is provided with a computation circuit which is combination with a calculation function key outside the keyboard, realizes the calculations adding, subtracting, dividing, and multiplying together with the keys carrying said signs and digits.

With this word or rapid typewriter, according to the invention, running and complete linguistic information of letters and/or signs and digits is displayed or processed in a very fast manner in standard form by the logical and simple construction of the keyboard in connection with the shift key thereon and the decoding and processing unit, whereby missing letters are formed, difficult combinations are facilitated and slit positions are avoided.

What is claimed is:

1. A word typewriter for the display of written information comprising a keyboard, the keyboard being provided with letter keys, the letter keys including a first centrally positioned group of letter keys for vowels, and on either side of said group in mirror positions a second and third group of letter keys for a limited number of consonants, the number of consonants represented by the second and third group of letter keys being less than the number of consonants appearing in a standard written format of the information to be processed, the keyboard being further provided with a row of letter keys below said groups conveniently operable by a typist's thumbs, the decoding of the letter keys being such that by simultaneous operation of more than one key, letters omitted from the keyboard are formed by the typewriter and provided in an order corresponding to a standard form of a word, the letter keys also being operable for the formation of signs or digits, a further row of two sign keys below said row of letter keys operable by the thumbs and between which a shift key is provided to selectively form letters and signs or digits, the letter keys being coupled to an electronic decoding and processing unit, the electronic decoding and processing unit being operable to decode signals from simultaneously operated keys and to subsequently supply signals representing a set of letters which are placed in an order corresponding to a standard form of a word, the combination of two simultaneously operated letter keys which may be associated with a letter omitted from the keyboard being processed into the standard display form of the letter omitted from the keyboard, the electronic decoding and processing unit serving as a means to process the simultaneous operation of keys in accordance with programmed priority rules and to produce a realtime output of signals representative of the standard form of a word, wherein the simultaneously operated letter keys which combine to form letters omitted from the keyboard are selected so that the combination of letters on those letter keys suggest in form or phonetic sound the missing letter so formed.

2. A word typewriter according to claim 1 further comprising near the lower edge of the keyboard a case shift bar for uppercase letter or lowercase letter display, said bar being operable by the ball of the typist's hand, the decoding and processing unit being operable to decode signals from said case shift bar for uppercase letter or lowercase letter display such that when said shift bar is separately pre-operated the following syllable starts with a capital, and when said case shift bar is operated simultaneously with one or a plurality of other letter keys, representing initial consonants, it is displayed as letter h.

3. A word typewriter according to claim 2, further comprising near the lower edge of the keyboard a space bar for linking-up or space display, said space bar being operable by the ball of the typist's hand, the decoding and processing unit being operable to decode signals from said space bar for linking-up or space display such that when said space bar is operated simultaneously with a syllable or separately when operating letter after letter, then the said syllable is displayed linked-up to the preceding syllable or the said letters in the letter after letter display are displayed with space therebetween.

4. A word typewriter according to claim 1, wherein on a number of letter keys also the digits 0 through 9 are provided such that they will be displayed when said keys are operated simultaneously with said shift key, the digits being distributed over the middle vowel group such that the digit 0 is placed on a middle thumb letter key, and the digits 1, 2, 3, and 4, 5, 6, and 7, 8, 9 successively are placed on three rows of three vowel keys.

5. A word typewriter according to claim 4, wherein the row of thumb letter keys consists of five keys, on the left two and on the right two thumb letter keys respectively the signs +, −, :, × are provided, and the decoding and processing unit comprising a computation circuit, which in combination with a calculation function key outside the keyboard accomplishes the calculations of adding, subtracting, dividing, and multiplying in cooperation with the keys carrying said signs and digits.

6. A word typewriter according to claim 1, wherein chord combinations of initial consonants and final consonants, which do not exist in normal language and which are simultaneously actuated, are used in the decoding and processing unit to selectively provide for specific keyboard functions of correction, line switching, and language switching.

7. A per-syllable typewriter for real-time processing of information capable of producing a legible output of the information in standard written format, comprising:

a keyboard, the keyboard having a plurality of keys, the keyboard being designed so that an operator's hands may remain in a substantially fixed position from which the fingers can reach all keys in order to permit rapid actuation of the keys, the keys being positioned so that most frequently used letters appearing in a standard written format of the information to be processed may be indicated by pressing a key which is positioned under the strongest fingers of the operator's hands, the keys being organized into three groups, the first group of keys being positioned on one side of the keyboard and being designated to represent initial consonants of a syllable, the second group of keys being positioned on the middle of the keyboard and being designated to represent vowels of a syllable, the third group of keys being positioned on a side of the keyboard remote from the first group of keys and being designated to represent final consonants of a syllable, the number of keys in each of the first group of keys and the third group of keys being less than the number of consonants appearing in a standard written format of the information to be processed, the keyboard further including a shift key positioned so that it may be actuated by a thumb of an operator's hand; and, an electronic decoding and processing unit, the decoding and processing unit being operatively coupled to the keyboard for receiving signals from the keyboard in response to actuation of the keys of the keyboard by an operator's hands, the decoding and processing unit being operative to interpret simultaneously actuated keys and to produce a real-time output indicative of the standard written format for representing the syllable corresponding to the simultaneously actuated keys, the decoding and processing unit being operative to process in real-time the simultaneously actuated keys whereby keys from the first group of keys are output in standard format as initial consonants of a syllable, keys from the second group of keys are output in standard format as vowels of a syllable, and keys from the third group of keys are output in standard format as final consonants of a syllable, the decoding and processing unit being operative to process in real-time simultaneous actuation of two consonant keys from the same group of keys, whereby simultaneously actuated consonant keys from the first group or third group of keys are output in standard format as consonants which are not represented by individual keys of the keyboard thereby supplying consonants missing from the keyboard in a standard format for output, the decoding and processing unit being operable when a syllable is indicated by simultaneous actuation of a plurality of keys on the keyboard to produce a real-time output representative of letters arranged in a sequence that corresponds to the standard written format for said syllable.

8. The per-syllable typewriter according to claim 7, further comprising:

a no-space bar, the no-space bar being located below the keys of the keyboard so that the no-space bar may be actuated by the ball of an operator's hand while the operator's hand remains in a fixed position, the no-space bar being operatively coupled to the electronic decoding and processing unit, the electronic decoding and processing unit being operative to automatically produce a real-time output representative of a space after a syllable unless the no-space bar is actuated by an operator's hand, thereby reducing manipulation of the keyboard when monosyllabic words occur more frequently than polysyllabic words in the standard written format of the information to be processed, the electronic decoding and processing unit being operative to produce a real-time output representative of the standard written format of two syllables linked into a word when the no-space bar is actuated by an operator's hand between two syllables, the decoding and processing unit being operative to automatically link, without a space, individual letters represented by the actuation of individual keys unless the no-space bar is actuated between the actuation of said individual keys.

9. A per-syllable typewriter according to claim 8, further comprising:

a capital-H bar, the capital-H bar being located below the keys of the keyboard so that the capital-H bar may be actuated by the ball of an operator's hand while the operator's hand remains in a relatively fixed position, the capital-H bar being operatively coupled to the electronic decoding and processing unit, the decoding and processing unit being operative to interpret the first letter of a syllable as a capital letter when the capital-H bar is actuated alone, prior to actuation of other keys representative of said syllable, the decoding and processing unit being operative to interpret the capital-H bar as the letter h when the capital-H bar is actuated simultaneously with other keys.

10. The per-syllable typewriter according to claim 9, wherein:

the keyboard has a key designated to represent a period, and the electronic decoding and processing unit being operative automatically to insert a space and to capitalize the following letter after a period has been indicated, unless the no-space bar and the capital-H bar are simultaneously actuated prior to a following syllable.

11. The per-syllable typewriter according to claim 10, wherein:

the electronic decoding and processing unit is operative to interpret the following letter, after a period has been indicated, as a lower case letter when the capital-H bar is actuated prior to said letter.

12. The per-syllable typewriter according to claim 11, wherein:

the electronic decoding and processing unit includes a diode matrix decoder operatively coupled to a processor having memory means and program means, and a buffer operatively coupled to the keyboard for storing signals representative of key actuation, whereby when keys of the keyboard have been actuated and released, signals representative of keys which were simultaneously actuated are stored in the buffer, the processor being operative to receive the signals from the buffer and to interpret a plurality of such signals into a standard written format representation of information.

13. The per-syllable typewriter according to claim 12, wherein:

the keyboard further includes signs and digits represented by said keys; and, the electronic decoding and processing unit is operative to selectively interpret key actuations as letters or signs and digits in response to actuation of the shift key.

14. The per-syllable typewriter according to claim 12, wherein:

the electronic decoding and processing unit is operative to interpret the simultaneous actuation of keys, which in combination cannot be interpreted as a valid representation of a standard written format of a syllable, as a control signal to selectively activate special functions.

15. The per-syllable typewriter according to claim 14, wherein:

the simultaneous actuation of the "C" and "R" keys from the first group of keys and the "R" and "C" keys from the third group of keys is interpreted by the electronic decoding and processing unit as a control signal to correct a previous syllable entry.

16. The per-syllable typewriter according to claim 14, wherein:

the second group of keys on the keyboard includes two keys designated to represent the same letter, the first key designated to represent said letter being operable by one of an operator's hands while such hand remains in a relatively fixed position, the second key designated to represent said letter being operable by the other hand of the operator, the electronic decoding and processing unit being operable to interpret the separate actuation of the first key as said letter and to interpret the separate actuation of the second key as a frequently used punctuation mark without the need for actuating the shift key.

17. The per-syllable typewriter according to claim 16, wherein:

the first group of keys on the keyboard includes keys designated to represent the letters "Z", "S", "F", "P", "T", "C", "K", "J", "r", "L", and "n", and missing consonants are obtained from the simultaneous actuation of two keys from the first group of keys;

the third group of keys on the keyboard includes keys designated to represent the letters "n", "L", "K", "J", "r", "P", "T", "C", "F", "S", "Z", and missing consonants are obtained from the simultaneous actuation of two keys from the third group of keys;

the first group of keys being located to the left of the second group of keys in the middle, and the third group of keys being located to the right of the second group of keys in the middle, the third group of keys being arranged symmetrically with respect to the first group of keys;

the keys of the keyboard being positioned so that the keys for the letters "Z", "F", and "S" are operable by an operator's little fingers, the keys for the letters "P", "T", and "C" are operable by an operator's ring fingers, the keys for the letters "K", "J", and "r" are operable by an operator's middle fingers, the keys in the second group of keys representing vowels can be operated by an operator's forefingers, and the keys for the letters "L" and "n" are operable by an operator's thumbs;

the electronic decoding and processing unit being operable to interpret the simultaneous actuation of keys in the first group of keys as beginning consonant combinations, as follows:

FJn interpreted as VR
TJn interpreted as DR
CJn interpreted as CR
PJn interpreted as BR to minimize awkward keystrokes and to avoid the need to press slit positions with weaker fingers; and, the electronic decoding and processing unit being operable to interpret the simultaneous actuation of the "n" key, the "J" key, from the first group of keys, and the capital-H bar as the beginning consonant combination "WR".

18. The per-syllable typewriter according to claim 17, wherein:

the electronic decoding and processing unit is operative to interpret the simultaneous actuation of keys from the first group of keys as beginning consonant combinations, as follows:

PK interpreted as PR
SPK interpreted as SPR
TK interpreted as TR
STK interpreted as STR
FK interpreted as FR and, the electronic decoding and processing unit is operative to interpret the simultaneous actuation of keys from the third group of keys, when such keys end a syllable and follow other letters in the syllable, as follows:

TZ interpreted as TS
PZ interpreted as PT
KT interpreted as CT
KTS interpreted as CTS
CZ interpreted as CH
GL interpreted as GH
GLZ interpreted as GHT in order to minimize the strain upon an operator's hand and to make keystrokes easier, and to minimize occasions when two keys must be actuated by either the operator's little finger, ring finger, or middle finger.

19. A per-syllable typewriter for real-time processing of information capable of producing a legible output of the information in standard written format which can be interpreted by an ordinary person, comprising:

a keyboard, the keyboard having a plurality of keys, the keyboard being designed so that an operator's hands may remain in a substantially fixed position from which the fingers can reach all keys in order to permit rapid actuation of the keys, the keys being positioned so that most frequently used letters appearing in a standard written format of the information to be processed may be indicated by pressing a key which is positioned under the strongest fingers of the operator's hands, the keys being organized into three groups, the first group of keys being positioned on one side of the keyboard and being designated to represent initial consonants of a syllable, the second group of keys being positioned on the middle of the keyboard and being designated to represent vowels of a syllable, the third group of keys being positioned on a side of the keyboard remote from the first group of keys and being designated to represent final consonants of a syllable, the number of keys in each of the first group of keys and the third group of keys being less than the number of consonants appearing in a standard written format of the information to be processed, the keyboard further including a shift key positioned so that it may be actuated by a thumb of an operator's hand;

an electronic decoding and processing unit, the decoding and processing unit being operatively coupled to the keyboard for receiving signals from the keyboard in response to actuation of the keys of the keyboard by an operator's hands, the decoding and processing unit being operative to interpret simultaneously actuated keys and to produce a real-time output which is substantially the standard written format for representing the syllable corresponding to the simultaneously actuated keys, the decoding and processing unit being operative to process in real-time the simultaneously actuated keys whereby keys from the first group of keys are output in standard format as initial consonants of a syllable, keys from the second group of keys are output in standard format as vowels of a syllable, and keys from the third group of keys are output in standard format as final consonants of a syllable, the decoding and processing unit being operative to process in real-time simultaneous actuation of two consonant keys from the same group of keys, whereby simultaneously actuated consonant keys from the first group or third group of keys are output in standard format as consonants which are not represented by individual keys of the keyboard thereby supplying consonants missing from the keyboard in a standard format for output, the decoding and processing unit being operable, when multiple syllables are each indicated by simultaneous actuation of a plurality of keys on the keyboard to produce a real-time output that substantially consists of letters arranged in a sequence that corresponds to the standard written format for words and sentences formed by said syllables;

a no-space bar, the no-space bar being located below the keys of the keyboard so that the no-space bar may be actuated by the ball of an operator's hand while the operator's hand remains in a fixed position, the no-space bar being operatively coupled to the electronic decoding and processing unit, the electronic decoding and processing unit being operative to automatically produce a real-time output of a space after a syllable unless the no-space bar is actuated by an operator's hand, thereby reducing manipulation of the keyboard when monosyllabic words occur more frequently than polysyllabic words in the standard written format of the information to be processed, the electronic decoding and processing unit being operative to produce a real-time output that substantially consists of the standard written format of two syllables linked into a word when the no-space bar is actuated by an operator's hand between two syllables, the decoding and processing unit being operative to automatically link, without a space, individual letters represented by the actuation of individual keys unless the no-space bar is actuated between the actuation of said individual keys;

a capital-H bar, the capital-H bar being located below the keys of the keyboard so that the capital-H bar may be actuated by the ball of an operator's hand while the operator's hand remains in a relatively fixed position, the capital-H bar being operatively coupled to the electronic decoding and processing unit, the decoding and processing unit being operative to interpret the first letter of a syllable as a capital letter when the capital-H bar is actuated alone, prior to actuation of other keys representative of said syllable, the decoding and processing unit being operative to interpret the capital-H bar as the letter h when the capital-H bar is actuated simultaneously with other keys, the decoding and processing unit being operative to produce an output in standard written format in accordance with its interpretation;

the electronic decoding and processing unit including a matrix decoder operatively coupled to a processor having memory means and program means, and a buffer operatively coupled to the keyboard for storing signals representative of key actuation, whereby when keys of the keyboard have been actuated and release, signals representative of keys which were simultaneously actuated are stored in the buffer, the processor being operative to receive the signals from the buffer and to interpret a plurality of such signals into a standard written format representation of information; and, display means for displaying a visually perceptible indication of information indicating the standard written format representation of key actuations.

20. The per-syllable typewriter according to claim 19, further comprising:

printer means for producing a printed copy of the standard written format representation of the information represented by key actuations.

21. The per-syllable typewriter according to claim 19, wherein:

the first group of keys on the keyboard includes keys designated to represent the letters "Z", "S", "F", "P", "T", "C", "K", "J", "r", "L", and "n", and missing consonants are obtained from the simultaneous actuation of two keys from the first group of keys;

the third group of keys on the keyboard includes keys designated to represent the letters "n", "L", "K", "J", "r", "P", "T", "C", "F", "S", "Z", and missing consonants are obtained from the simultaneous actuation of two keys from the third group of keys;

the first group of keys being located to the left of the second group of keys in the middle, and the third group of keys being located to the right of the second group of keys in the middle, the third group of keys being arranged symmetrically with respect to the first group of keys;

the keys of the keyboard being positioned so that the keys for the letters "Z", "F", and "S" are operable by an operator's little fingers, the keys for the letters "P", "T", and "C" are operable by an operator's ring fingers, the keys for the letters "K", "J", and "r" are operable by an operator's middle fingers, the keys in the second group of keys representing vowels can be operated by an operator's forefingers, and the keys for the letters "L" and "n" are operable by an operator 's thumbs;

the electronic decoding and processing unit being operable to interpret the simultaneous actuation of keys in the first group of keys as beginning consonant combinations, as follows:

FJn interpreted as VR
TJn interpreted as DR
CJn interpreted as CR
PJn interpreted as BR to minimize awkward keystrokes and to avoid difficult keystrokes with weaker fingers; and, the electronic decoding and processing unit being operable to interpret the simultaneous actuation of the "n" key, the "J" key, from the first group of keys, and the capital-H bar as the beginning consonant combination "WR".

22. The per-syllable typewriter according to claim 21, wherein:

the electronic decoding and processing unit is operative to interpret the simultaneous actuation of keys from the first group of keys as beginning consonant combinations, as follows:

PK interpreted as PR
SPK interpreted as SPR
TK interpreted as TR
STK interpreted as STR
FK interpreted as FR and, the electronic decoding and processing unit is operative to interpret the simultaneous actuation of keys from the third group of keys, when such keys end a syllable and follow other letters in the syllable, as follows:

TZ interpreted as TS
PZ interpreted as PT
KT interpreted as CT
KTS interpreted as CTS CZ interpreted as CH
GL interpreted as GH
GLZ interpreted as GHT
in order to minimize the strain upon an operator's hand and to make keystrokes easier, and to minimize occasions when two keys must be actuated by either the operator's little finger, ring finger, or middle finger.

* * * * *

UNITED STATES PATENT AND TRADEMARK OFFICE

CERTIFICATE OF CORRECTION

PATENT NO. : 4,804,279

DATED : February 14, 1989

INVENTOR(S) : Nicolaas M. Berkelmans and Marius den Outer

It is certified that error appears in the above-identified patent and that said Letters Patent is hereby corrected as shown below:

Column 2, line 39, after "respectively", insert a comma.

Column 2, line 41, change "accentuations " " and " "." to -- accentuations "´" and "`". --.

Column 9, line 21, change "8K" to -- 8S, --.

Column 9, line 22, after "Dutch,", insert -- English --.

Column 9, after line 25, insert the following:

-- KEYBOARD HANDLING

The disclosed system is optimized in two ways in relation to keyboard handling. The keyboard layout has been chosen in such a way that the path length of the finger movement is minimal and the most frequently used keys are direct under the fingertips. For every language the keyboard handling program is specially tailored in order to achieve the maximum performance.

To improve the typing speed even further, many automatic functions in relation to the output produced by the disclosed system have been incorporated. Examples are the automatice insertion of a space after every word and the generation of a capital as the first letter of the next word after a full stop, question mark or exclamation mark.

UNITED STATES PATENT AND TRADEMARK OFFICE

CERTIFICATE OF CORRECTION

PATENT NO. : 4,804,279

DATED : February 14, 1989

INVENTOR(S) : Nicolaas M. Berkelmans and Marius den Outer

It is certified that error appears in the above-identified patent and that said Letters Patent is hereby corrected as shown below:

Details of the language programs are given in separate listings consisting of the flowcharts (see Figures 8A-8S) and the source codes (see Figures 9A-9V) for the Dutch, English and German languages.

The source code is compiled into object code which in turn is processed by a language interpreter routine in the main program of the disclosed system. The source code is an almost one to one copy of the flowchart, except for certain minor differences, which are there to save some object code.

An explanation of how to read the flowcharts follows.

Using the lefthand key Z as an example, the flowchart is given below:

```
Z---K(res)---OUT=X-----------------------:
#   #                                    :
:   ---P(res)-------OUT=P----OUT=S-------:
:      #                                 :
:      ---T(res)----OUT=T----OUT=S-------:
:         #                              :
:         ---C(res)---OUT=Cc------>------:
:            #                           :
:            ---C(sc)---OUT=Z----->------:
:                                        :
:-----<---------<-----------<---------<--:
:
S---.........
#
:
```

UNITED STATES PATENT AND TRADEMARK OFFICE

CERTIFICATE OF CORRECTION

PATENT NO. : 4,804,279

DATED : February 14, 1989

INVENTOR(S) : Nicolaas M. Berkelmans and Marius den Outer

It is certified that error appears in the above-identified patent and that said Letters Patent is hereby corrected as shown below:

It should be read as follows:

If the Z-key is pushed (--- line), then look if the K-key is pushed.

If the Z-key is not pushed (# line), then go to the next key; in this case the S-key.

If the K-key is pushed, then reset the K-key down condition and output the letter X. The key down condition is reset in order to permit the language interpreter to process the K-key again later in the program.

The letter X is thus made by the combination of the Z-key and the K-key.

If the K-key is not pushed, then check if the P-key is pushed; if it is, then output the letters PS (words like PSeudo...). Thus lefthand letters PS are made by pushing the keys Z and P.

In the same way the keys T and C are checked whereby the combination ZT outputs TS and the combination ZC outputs the French C-cedille (Cc).

If none of the keys K, P, T and C are present, the condition bit in the C-key byte is set to remember that the Z-key was pushed. This condition bit is used later on in the program to control the program flow.

It is certified that error appears in the above-identified patent and that said Letters Patent is hereby corrected as shown below:

After the C-key condition bit is set, the letter Z is output and the program moves to the next key, in this case the S-key.

By checking the keys in the order given in the flowcharts, the output sequence of the letters is determined; e.g., the word STOP is always output as STOP and never as TSOP because the S-key is processed before the T-key and so the output is always in the order S before T.

The automatic ordering of the keys and key combinations is one of the main properties of the disclosed system and forms the basis for high speed typing.

EXPLANATION OF MNEMONICS USED IN THE FLOWCHARTS

| | |
|---|---|
| Z--- | If Z-key is pushed go to ..... (condition true) |
| Z # | If Z-key is not pushed go to ..... (condition false) |
| K(res)--- | Same as above but key down condition is reset |
| C(sc) | Set condition bit in C-key byte |
| C(c) | Test condition bit in C-key byte |
| OUT=xx | OUTPUT the character(s) xx |
| >>>Txyz | Go to label xyz |
| LANG=E | Test if language is English |
| XPnn | Test if expression nn is true or false |

It is certified that error appears in the above-identified patent and that said Letters Patent is hereby corrected as shown below:

| | |
|---|---|
| NKYx=y | Test if the number of keys pushed in block x equals y |

EXPLANATION OF LANGUAGE SOURCE CODE NMEMONICS

| | |
|---|---|
| K-j- | TEST IF KEY j IS PUSHED DOWN |
| R-j- | TEST IF KEY j IS PUSHED DOWN AND RESET KEY j DOWN CONDITION |
| C-j- | TEST IF CONDITION BIT IN KEY j CODE IS SET |
| S-j- | SET CONDITION BIT IN KEY j CODE |
| O-j- | OUTPUT CHARACTER j |
| H-xx- | HEXADECIMAL OUTPUT xx |
| $-yyy- | OUTPUT STRING yyy |
| J T123 | JUMP TO LABEL T123 (offset < 256) |
| JL T456 | JUMP TO LABEL T456 (offset >= 256) |
| L=E | TEST IF LANGUAGE IS ENGLISH (E=English N=Dutch D=German) |
| Xnn | TEST IF EXPRESION NUMBER nn IS TRUE (EXPRESSIONS are combinations of KEYS AND/OR CONDITIONS) |
| Y3=6 | TEST IF THE NUMBER OF KEYS PUSHED DOWN IN BLOCK 3 IS 6 |

UNITED STATES PATENT AND TRADEMARK OFFICE
CERTIFICATE OF CORRECTION

PATENT NO. : 4,804,279

DATED : February 14, 1989

INVENTOR(S) : Nicolaas M. Berkelmans and Marius den Outer

It is certified that error appears in the above-identified patent and that said Letters Patent is hereby corrected as shown below:

| | |
|---|---|
| FIN | END OF BLOCK PROCESSING (GO TO NEXT BLOCK) |
| ; | END OF KEY PROCESSING (GO TO NEXT KEY) |
| END | END OF SOURCE CODE |
| *ccccc* | COMMENT LINE --. |

Column 9, line 65, change "inset" to -- insert --

Column 13, line 43, change "9K" to -- 9V --.

Column 13, line 61, after "two part" insert -- circuit drawings entitled "Print KB-SSI/00," drawing nos. --.

Column 14, line 5, after "Corporation" insert a comma.

Column 17, line 19, change "an" to -- and --.

Column 17, line 30, change "accentuations " " and " "." to -- accentuations "´" and "`". --.

UNITED STATES PATENT AND TRADEMARK OFFICE
CERTIFICATE OF CORRECTION

PATENT NO. : 4,804,279

DATED : February 14, 1989

INVENTOR(S) : Nicolaas M. Berkelmans and Marius den Outer

It is certified that error appears in the above-identified patent and that said Letters Patent is hereby corrected as shown below:

Column 19, the chart should be as follows:

| to be actuated | display |
|---|---|
| - TZ | - TS |
| - PZ | - PT |
| - KT(S) | - CT(S) |
| OI | A (in basic position) |
| - CZ | - CH |
| - GL | - GH |
| - GLZ | - GHT |

Column 27, line 58, change "release" to -- released --.

Signed and Sealed this

Twenty-first Day of November, 1989

*Attest:*

JEFFREY M. SAMUELS

*Attesting Officer* *Acting Commissioner of Patents and Trademarks*